US011713637B2

(12) United States Patent
Rairigh

(10) Patent No.: US 11,713,637 B2
(45) Date of Patent: Aug. 1, 2023

(54) DUAL END FIRING EXPLOSIVE COLUMN TOOLS AND METHODS FOR SELECTIVELY EXPANDING A WALL OF A TUBULAR

(71) Applicant: James G. Rairigh, Houston, TX (US)

(72) Inventor: James G. Rairigh, Houston, TX (US)

( * ) Notice: Subject to any disclaimer, the term of this patent is extended or adjusted under 35 U.S.C. 154(b) by 0 days.

(21) Appl. No.: 17/967,705

(22) Filed: Oct. 17, 2022

(65) Prior Publication Data

US 2023/0050277 A1 Feb. 16, 2023

Related U.S. Application Data

(63) Continuation of application No. 17/240,662, filed on Apr. 26, 2021, now Pat. No. 11,473,383, which is a (Continued)

(51) Int. Cl.

| | |
|---|---|
| ***E21B 29/02*** | (2006.01) |
| ***E21B 33/13*** | (2006.01) |
| ***E21B 43/10*** | (2006.01) |

(52) U.S. Cl.

CPC ..... *E21B 29/02* (2013.01); *E21B 33/13* (2013.01); *E21B 43/105* (2013.01)

(58) Field of Classification Search

CPC ..... E21B 29/02; E21B 33/13; E21B 43/105
See application file for complete search history.

(56) References Cited

U.S. PATENT DOCUMENTS 2,214,226 A * 9/1940 English ..... E21B 29/10 166/299
2,684,030 A 7/1954 Muskat et al.
(Continued)

FOREIGN PATENT DOCUMENTS

EP 0079716 B1 3/1987
FR 1155464 A 5/1958
(Continued)

OTHER PUBLICATIONS

International Search Report and Written Opinion of the International Searching Authority, issued by the U.S Patent & Trademark Office in PCT/2019/046920 dated Jan. 9, 2020 (57 pages).
(Continued)

*Primary Examiner* — Steven A Macdonald
(74) *Attorney, Agent, or Firm* — McCutcheon Joseph, PLLC

(57) ABSTRACT

A method of selectively expanding a wall of a tubular includes assembling an expansion tool comprising a plurality of bi-directional boosters, arranging a predetermined number of explosive pellets a serially-arranged column between the bi-directional boosters, positioning a duel end firing explosive column tool within the tubular, and detonating the bi-directional boosters to simultaneously ignite opposing ends of the serially-arranged column to form two shock waves. The shock waves collide to create an amplified shock wave that travels radially outward to impact the tubular and expand a portion of the tubular wall radially outward, without perforating or cutting through the portion of the wall, to form a protrusion of the tubular at the portion of the wall. The protrusion extends into an annulus adjacent an outer surface of the wall of the tubular.

15 Claims, 16 Drawing Sheets

Related U.S. Application Data continuation of application No. 16/970,605, filed as application No. PCT/US2019/046692 on Aug. 15, 2019, now Pat. No. 11,015,410.

(60) Provisional application No. 62/764,857, filed on Aug. 16, 2018.

(56) References Cited

U.S. PATENT DOCUMENTS

| | | | | |
|---|---|---|---|---|
| 3,013,333 | A | 12/1961 | Burke | |
| 3,167,122 | A * | 1/1965 | Lang | E21B 29/10 29/421.2 |
| 3,590,877 | A * | 7/1971 | Leopold | F42D 3/00 165/137 |
| 4,184,430 | A * | 1/1980 | Mock | E21B 29/02 102/307 |
| 4,449,280 | A | 5/1984 | Schroeder | |
| 4,585,374 | A | 4/1986 | Regalbuto et al. | |
| 4,672,832 | A * | 6/1987 | Merker | B21D 39/042 72/62 |
| 4,724,767 | A | 2/1988 | Aseltine | |
| 4,850,438 | A | 7/1989 | Regalbuto | |
| 4,966,237 | A | 10/1990 | Swanson et al. | |
| 5,038,683 | A | 8/1991 | Baker et al. | |
| 5,753,850 | A | 5/1998 | Chawla et al. | |
| 7,104,326 | B2 * | 9/2006 | Grattan | E21B 29/02 175/4.6 |
| 8,939,210 | B2 * | 1/2015 | Bell | E21B 33/124 166/299 |
| 9,022,116 | B2 | 5/2015 | Bell et al. | |
| 9,435,170 | B2 * | 9/2016 | Bell | E21B 29/02 |
| 9,879,494 | B2 * | 1/2018 | Bell | E21B 29/02 |
| 10,316,627 | B2 | 6/2019 | Brisco et al. | |
| 11,473,383 | B2 * | 10/2022 | Rairigh | E21B 43/105 |
| 2002/0157830 | A1 | 10/2002 | Simpson | |
| 2003/0221579 | A1 | 12/2003 | Grattan | |
| 2004/0154492 | A1 | 8/2004 | Barnhart | |
| 2004/0251034 | A1 | 12/2004 | Kendziora et al. | |
| 2004/0256112 | A1 | 12/2004 | Harrall et al. | |
| 2005/0061506 | A1 | 3/2005 | Grove et al. | |
| 2005/0126783 | A1 * | 6/2005 | Grattan | E21B 29/02 166/55 |
| 2006/0075888 | A1 | 4/2006 | Yang et al. | |
| 2006/0086501 | A1 | 4/2006 | Creel et al. | |
| 2012/0312561 | A1 * | 12/2012 | Hallundæk | E21B 29/10 166/207 |
| 2013/0299194 | A1 | 11/2013 | Bell et al. | |
| 2014/0076550 | A1 | 3/2014 | Pelletier et al. | |
| 2014/0338910 | A1 * | 11/2014 | Bell | E21B 33/124 166/55 |
| 2015/0198000 | A1 * | 7/2015 | Bell | E21B 33/124 166/55 |
| 2015/0233219 | A1 | 8/2015 | Bell et al. | |
| 2015/0361774 | A1 | 12/2015 | Flores | |
| 2016/0010414 | A1 * | 1/2016 | Bell | E21B 29/02 166/55 |
| 2016/0010423 | A1 * | 1/2016 | Myhre | E21B 37/00 166/285 |
| 2016/0032706 | A1 | 2/2016 | Bomaz et al. | |
| 2016/0123122 | A1 | 5/2016 | Van Dongen et al. | |
| 2016/0130902 | A1 | 5/2016 | Wright et al. | |
| 2016/0369584 | A1 * | 12/2016 | Bell | E21B 33/124 |
| 2017/0145778 | A1 | 5/2017 | Zijsling et al. | |
| 2017/0145797 | A1 | 5/2017 | Stam et al. | |
| 2017/0191328 | A1 | 7/2017 | Sokolove et al. | |
| 2018/0094504 | A1 * | 4/2018 | Hearn | E21B 33/13 |
| 2018/0187528 | A1 | 7/2018 | Di Crescenzo et al. | |
| 2018/0252507 | A1 | 9/2018 | Collier | |
| 2018/0298720 | A1 | 10/2018 | Billingham et al. | |
| 2022/0003085 | A1 | 1/2022 | Loehken | |

FOREIGN PATENT DOCUMENTS

| | | | |
|---|---|---|---|
| JP | 4017111 | B2 | 12/2007 |
| NO | 20180152 | A1 | 4/2018 |
| WO | WO2014/108431 | A2 | 7/2014 |
| WO | 2014148913 | A1 | 9/2014 |
| WO | 2014202419 | A1 | 12/2014 |
| WO | WO2020/016169 | A1 | 1/2020 |

OTHER PUBLICATIONS

International Preliminary report on Patentability, issued by the U.S. Patent & Trademark Office in PCT/2019/046920 on Jun. 25, 2020 (12 pages).

International Search Report and Written Opinion of the International Searching Authority, issued by the U.S Patent & Trademark Office in PCT/2019/046692 dated Nov. 6, 2019 (80 pages).

Written Opinion of the International Preliminary Examining Authority, issued by the U.S. Patent & Trademark Office in PCT/2019/046692 dated Aug. 11, 2020 (5 pages).

Office Action issued by the U.S. Patent & Trademark Office dated Nov. 24, 2020 in U.S. Appl. No. 16/970,602 (23 pages).

Office Action issued by the Canadian Intellectual Property Office dated Mar. 10, 2021 in CA Patent Application No. 3,109,219 (7 pages).

Office Action issued by the Canadian Intellectual Property Office dated Mar. 18, 2021 in CA Patent Application No. 3,109,407 (4 pages).

Office Action issued by the U.S. Patent & Trademark Office dated Jun. 23, 2022 in U.S. Appl. No. 17/240,611.

Office Action issued by the U.S. Patent & Trademark Office dated Mar. 8, 2022 in U.S. Appl. No. 17/126,982 (25 pages).

European Extended Search Report cited in EP 19849212.6 dated Apr. 7, 2022 (7 pages).

European Extended Search Report cited in EP 19849454.4 dated Apr. 19, 2022 (10 pages).

Notice of Allowance issued by the U.S. Patent & Trademark Office dated Sep. 29, 2022 in U.S. Appl. No. 17/313,828.

* cited by examiner

DETAIL A

DETAIL B

DETAIL A

DETAIL B

DUAL END FIRING EXPLOSIVE COLUMN TOOLS AND METHODS FOR SELECTIVELY EXPANDING A WALL OF A TUBULAR

CROSS REFERENCE TO RELATED APPLICATIONS

The present application is a continuation of U.S. patent application Ser. No. 17/240,662, filed on Apr. 26, 2021, which is a continuation of U.S. patent application Ser. No. 16/970,605, filed on Aug. 17, 2020, which is a U.S. national stage application claiming priority to patent cooperation treaty (PCT) Application No. PCT/2019/046692 filed on Aug. 15, 2019, that in turn claims priority to U.S. Provisional Patent Application No. 62/764,857, filed on Aug. 16, 2018, with all patents and patent applications, as set forth above, having a title of "Dual End Firing Explosive Column Tools and Methods for Selectively Expanding a Wall of a Tubular." The contents of the prior applications are hereby incorporated by reference herein in their entirety.

FIELD OF THE INVENTION

Embodiments of the present invention relate, generally, to dual end firing explosive column tools for selectively expanding a wall of a tubular good including, but not limited to, pipe, tube, casing and/or casing liner. The dual end firing explosive column tools selectively expand the wall radially outward. The present disclosure further relates to shaped charge tools for selectively expanding a wall of a tubular good including, but not limited to, pipe, tube, casing and/or casing liner. The present disclosure also relates to methods of selectively expanding a wall of a tubular good.

BACKGROUND

Explosive, mechanical, chemical or thermite cutting devices have been used in the petroleum drilling and exploration industry to cleanly sever a joint of tubing or casing deeply within a wellbore. Such devices are typically conveyed into a well for detonation on a wireline or length of coiled tubing. The devices may also be pumped downhole.

Known shaped charge explosive cutters include a consolidated amount of explosive material having an external surface clad with a thin metal liner. When detonated at the axial center of the packed material, an explosive shock wave which may have a pressure force as high as 20,684,272 Kpa (3,000.000 psi), advances radially along a plane against the liner to fluidize the liner and drive the fluidized liner lineally and radially outward against the surrounding pipe. The fluidized liner cuts through and severs the pipe. Other cutters include a set of pellets formed of explosive material. The set is ignited to produce a shock wave that severs the surrounding pipe.

A need exists for systems and methods that can control the shock wave of an explosive cutter, such that the controlled explosive shock wave results in a controlled outward, or radial, expansion of a wall of a targeted pipe or other tubular member, without severing or penetrating the targeted pipe or other tubular member.

A need exists for cost effective apparatus, systems and methods that can produce a selective outward expansion or protrusion of a wall of a targeted pipe or other tubular member at a strategic location(s), and along a desired length thereof.

A need exists for systems and methods that can produce a selective outward protrusion of a wall of a targeted pipe or other tubular member, which can extend into an annulus that is present between the outer surface of the pipe or other tubular member and an inner surface of a surrounding tubular, for improving the sealing of the annulus. Further, such systems and methods must render significant reductions in the cost of plug-and-abandonment and side-tracking operations in oil wells.

The present invention meets all of these needs.

SUMMARY

Embodiments of the present invention relate, generally, to dual end firing explosive column tools for selectively expanding a wall of a tubular good including, but not limited to, pipe, tube, casing and/or casing liner, where the dual end firing explosive column tools selectively expand the wall of the tubular good radially outward. In addition, embodiments of the present invention relate to shaped charge tools and methods of use for selectively expanding a wall of a tubular good including, but not limited to, pipe, tube, casing and/or casing liner.

The present application includes embodiments that are directed to the selective control of the shock wave(s) of an explosion so that a pipe or other tubular member is not penetrated or severed. The explosive shock wave can result in a controlled outward, or radial, expansion of the wall of the pipe or other tubular member. Selective outward expansion of the wall of the pipe or other tubular member, at strategic locations along the length thereof, can provide a designed protrusion of the wall of the pipe or other tubular member. The protrusion can extend into an annulus that is present between the outer surface of the pipe or other tubular member and an inner surface of a surrounding tubular. The extension of the protrusion into the annulus may form a ledge/restriction to help seal the annulus at the location of the protrusion. The seal forming protrusion of the expanded tubular wall may dramatically reduce the cost of plug-and-abandonment operations in oil wells. The degree of expansion of the tubular wall may be based on what, if any, material (e.g., cement, barite, other sealing materials, drilling mud, etc.) is present in the annulus. Generally, all deleterious flow through the cemented annulus may be referred to as annulus flow, and the disclosure herein discusses methods for reducing or eliminating annulus flow.

Dual end fired cylindrical explosive column tools (e.g., modified pressure balanced or pressure bearing severing tools) produce a focused energetic reaction, but with much less focus than from shaped charge explosives. The focus is achieved via the dual end firing of the explosive column, in which the two explosive wave fronts collide in a middle part of the column, amplifying the pressure radially. The length of the selective expansion is a function of the length of the explosive column, and may generally be about two times the length of the explosive column. With a relatively longer expansion length, for example, 40.64 centimeters (16.0 inches) as compared to a 10.16 centimeter (4.0 inch) expansion length with a shaped charge explosive device, a much more gradual expansion is realized. The more gradual expansion allows a greater expansion of any tubular or pipe prior to exceeding the elastic strength of the tubular or pipe, and failure of the tubular or pipe (i.e., the tubular or pipe being breeched).

One embodiment of the disclosure relates to a method of selectively expanding at least a portion of a wall of a tubular via an expansion tool. The method may comprise assembling the expansion tool, which comprises a guide tube that includes a plurality of bi directional boosters, and arranging a predetermined number of explosive pellets on the guide tube to be in a serially-arranged column between the plurality of bi-directional boosters. The method can continue by positioning the expansion tool within the tubular and detonating the plurality of bi-directional boosters to simultaneously ignite opposing ends of the serially-arranged column to form two shock waves. The shock waves collide to create an amplified shock wave that can travel radially outward to impact the tubular at a first location and to expand the at least a portion of the wall of the tubular radially outward, without perforating or cutting through the at least a portion of the wall. This expansion forms a protrusion of the tubular at said at least a portion of the wall. The protrusion can extend into an annulus, between an outer surface of the wall of the tubular and an inner surface of a wall of another tubular.

In an embodiment, formation of the protrusion causes the at least a portion of the wall that forms the protrusion to be work-hardened so that the at least a portion of the wall forming the protrusion has a greater yield strength than other portions of the wall that are adjacent the protrusion.

In an embodiment, the method can comprise expanding the wall of the tubular at a second location spaced from the first location, and in a direction parallel to an axis of the expansion tool, to create a pocket outside the tubular between the first location and second the location, wherein the sealant is located in the pocket.

Embodiments of the present invention include a method of selectively expanding at least a portion of a wall of a tubular via an expansion tool, which is configured to hold one or more explosive pellets, wherein the method for selective expansion of the wall of the tubular can be dependent upon a number of factors. These factors can include: (1) determining a material of the tubular to be expanded, (2) determining a thickness of a wall of the tubular to be expanded. (3) determining an inner diameter of the tubular to be expanded, (4) determining an outer diameter of the tubular to be expanded. (5) determining a hydrostatic force bearing on the tubular to be expanded. (6) determining a size of a protrusion to be formed in the wall of the tubular to be expanded, (7) calculating, or determining via a test, an explosive force necessary to expand, without puncturing, the wall of the tubular to form the protrusion, based on the determinations of the material of the tubular, the thickness of the wall of the tubular, the inner diameter of the tubular, the outer diameter of the tubular, the hydrostatic force bearing on the tubular, and the size of the protrusion; (8) selecting a predetermined number of explosive pellets to be added to the expansion tool depending on the value of the explosive force necessary, and adding the predetermined number of explosive pellets to the expansion tool; (9) positioning the expansion tool within the tubular, and (10) actuating the expansion tool to expand the wall of the tubular radially outward without perforating or cutting through the wall, to form the protrusion. The protrusion may extend into an annulus between an outer surface of the wall of the tubular and an inner surface of a wall of an adjacent tubular.

In the method, the explosive pellets are serially aligned along an axis of the expansion tool.

Another embodiment of a method of selectively expanding at least a portion of a wall of a tubular via a shaped charge expansion tool, which is configured to hold one or more explosive material units, may comprise: (1) determining a material of the tubular to be expanded, (2) determining a thickness of a wall of the tubular to be expanded, (3) determining an inner diameter of the tubular to be expanded, (4) determining an outer diameter of the tubular to be expanded, (5) determining a hydrostatic force bearing on the tubular to be expanded, (6) determining a size of a protrusion to be formed in the wall of the tubular, and (7) calculating, or determining via a test, an explosive force necessary to expand, without puncturing, the wall of the tubular to form the protrusion, based on the determinations of the material of the tubular, the thickness of the wall of the tubular, the inner diameter of the tubular, the outer diameter of the tubular, the hydrostatic force bearing on the tubular, and the size of the protrusion; (8) selecting an amount of explosive material for the one or more explosive material units depending on the value of the explosive force necessary, and adding the one or more explosive material units to the shaped charge expansion tool; (9) positioning the shaped charge expansion tool within the tubular, and (10) actuating the shaped charge expansion tool to expand the wall of the tubular radially outward without perforating or cutting through the wall, to form the protrusion, wherein the protrusion extends into an annulus adjacent an outer surface of the wall of the tubular. This embodiment of the method includes an exterior surface of the one or more explosive material units that is without a liner.

A further embodiment of a method of selectively expanding at least a portion of a wall of a tubular via an expansion tool, which is configured to hold explosive material, may comprise: determining a hydrostatic pressure bearing on the tubular; calculating an explosive force necessary to expand, without puncturing, the wall of the tubular to form a protrusion, based on the hydrostatic pressure; adding an amount of explosive material to the expansion tool depending on the calculated explosive force necessary; positioning the expansion tool within the tubular; and actuating the expansion tool to expand the wall of the tubular radially outward without perforating or cutting through the wall to form the protrusion, wherein the protrusion extends into an annulus between an outer surface of the wall of the tubular and an inner surface of a wall of another tubular. The method may further comprise determining a physical property of the tubular including at least one of: a material of the tubular; a thickness of the wall of the tubular; an inner diameter of the tubular; an outer diameter of the tubular; and a size of a protrusion to be formed in the wall of the tubular, wherein the explosive three is calculated based also on the physical property of the tubular.

BRIEF DESCRIPTION OF THE DRAWINGS

Various embodiments are hereafter described in detail and with reference to the drawings wherein like reference characters designate like or similar elements throughout the several figures and views that collectively comprise the drawings.

DETAILED DESCRIPTION OF THE INVENTION

Before explaining the disclosed embodiments in detail, it is to be understood that the present disclosure is not limited to the particular embodiments depicted or described, and that the invention can be practiced or carried out in various ways. The disclosure and description herein are illustrative and explanatory of one or more presently preferred embodiments and variations thereof, and it will be appreciated by those skilled in the art that various changes in the design, organization, means of operation, structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views to facilitate understanding or explanation. Further, the relative size and arrangement of the components may differ from that shown and still operate within the spirit of the invention.

Moreover, as used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments discussed herein. However, when applied to equipment and methods for use in wells that are deviated or horizontal, such terms may refer to a left to right, right to left, or other relationship as appropriate. In the specification and appended claims, the terms "pipe", "tube", "tubular", "casing" and/or "other tubular goods" are to be interpreted and defined generically to mean any and all of such elements without limitation of industry usage. Because many varying and different embodiments may be made within the scope of the concept(s) herein taught, and because many modifications may be made in the embodiments described herein, it is to be understood that the details herein are to be interpreted as illustrative and non-limiting.

Figure 2:
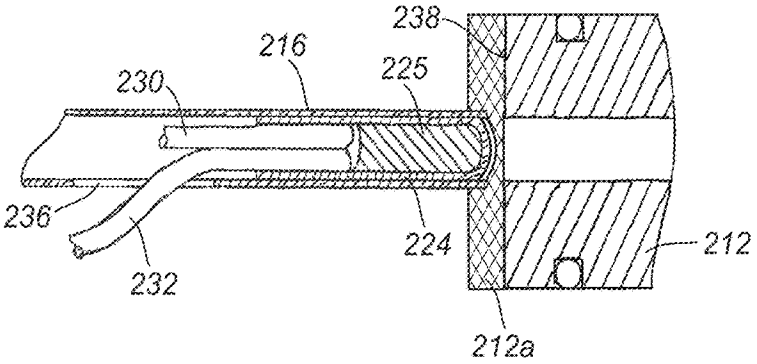
FIG. 2 is an enlargement of Detail A in FIG. 1.
Figure 3:
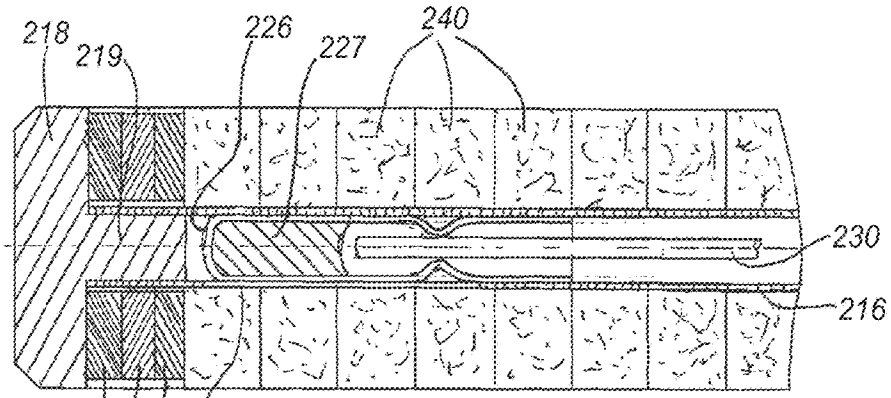
FIG. 3 is an enlargement of Detail B in FIG. 1.
Figure 1:
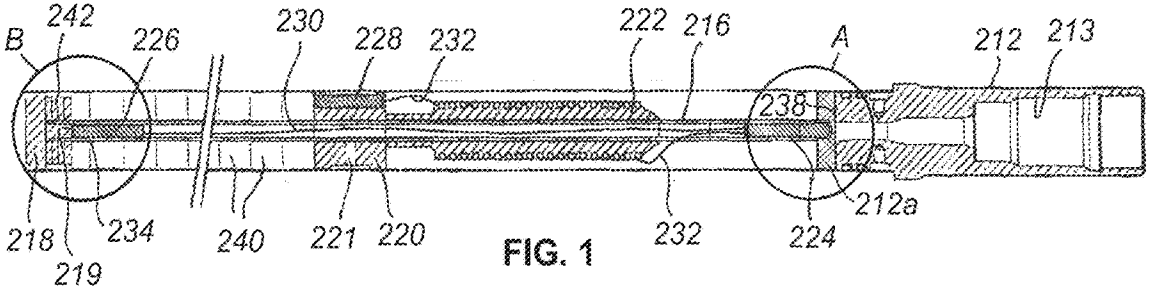
FIG. 1 is a cross-section of an embodiment of a dual firing end explosive column tool, as assembled for operation, for selectively expanding at least a portion of a wall of a tubular.

An embodiment of an expansion tool 1 for selectively expanding at least a portion of a wall of a tubular is shown in FIGS. 1-3. The expansion tool 1, as shown in this embodiment, is a dual end firing explosive column tool, and can be used for applications involving relatively large and thicker tubulars, such as pipes having a 6.4 centimeter (2.5 inch) wall thickness, an inner diameter of 22.9 centimeters (9.0 inches) or more and an outer diameter of 35.6 centimeters (14.0 inches) or more. However, the dual end firing explosive column tool 1 is not limited to use with such larger tubulars, and may effectively be used to expand the wall of smaller diameter tubulars and tubulars with thinner walls than discussed above, or with larger diameter tubulars and tubulars with ticker walls than discussed above.

FIG. 1 shows a cross-sectional view of an embodiment of the dual end firing explosive column tool 1. In this embodiment, the dual end firing explosive column tool 1 is a modified pressure balanced pellet tool. FIGS. 2 and 3 show details of particular portions of the dual end firing explosive column tool 1. As shown, the dual end firing explosive column tool 1 can include a top sub 212 at a proximal end thereof. An internal cavity 213 in the top sub 212 can be formed to receive a firing head (not shown). A guide tube 216 can be secured to the top sub 212 to project from an inside face 238 of the top sub 212 along an axis of the tool 1. The opposite distal end of guide tube 216 can support a guide tube terminal 218, which can be shaped as a disc. A threaded boss 219 can secure the terminal 218 to the guide tube 216. One or more resilient spacers 242, such as silicon foam washers, can be positioned to encompass the guide tube 216 and bear against the upper face of the terminal 218.

The dual end firing explosive column tool 1 can be arranged to serially align a plurality of high explosive pellets 240 along a central tube to form an explosive column. The pellets 240 may be pressed at forces to keep well fluid from migrating into the pellets 240. In addition, or in the alternative, the pellets 240 may be coated or sealed with glyptal or lacquer, or other compound(s), to prevent well fluid from migrating into the pellets 240. The dual end firing explosive column toot 1, as shown, is provided without an exterior housing so that the explosive pellets 240 can be exposed to an outside of the dual end firing explosive column tool 1, meaning that there is no housing of the dual end firing explosive column tool 1 covering the pellets 240. That is, when the dual end firing explosive column tool 1 is inserted into a pipe or other tubular, the explosive pellets 240 can be exposed to an inner surface of the pipe or other tubular. Alternatively, a sheet of thin material, or "scab housing" (not shown) may be provided with the dual end firing explosive column tool 1 to cover the pellets 240, for protecting the explosive material during running into the well. The material of the "scab housing" can be thin enough so that its effect on the explosive impact of the pellets 240 on the surface of the pipe or other tubular is immaterial. Moreover, the explosive force can vaporize the "scab housing" so that no debris from the "scab housing" is left in the wellbore. In some embodiments, the "scab housing" may be formed of Teflon, PEEK, or ceramic materials. Bi-directional detonation boosters 224, 226 are positioned and connected to detonation cords 230, 232 for simultaneous detonation at opposite ends of the explosive column. Each of the pellets 240 can comprise about 22.7 grams (0.801 ounces) to about 38.8 grams (1.37 ounces) of high order explosive, such as RDX, HMX or HNS. The pellet density can be from, e.g., about 1.6 g/cm$^3$ (0.92 ox/in$^3$) to about 1.65 g/cm$^3$ (0.95 oz/in$^3$), to achieve a shock wave velocity greater than about 9,144 meters/sec (30,000 ft/sec), for example.

A shock wave of such magnitude can provide a pulse of pressure in the order of 27.6 Gpa (4×10$^6$ psi). It is the pressure pulse that expands the wall of the tubular. The pellets 240 can be compacted at a production facility into a cylindrical shape for serial, juxtaposed loading at the jobsite, as a column in the dual end firing explosive column tool 1. The dual end firing explosive column tool 1 can be configured to detonate the explosive pellet column at both ends simultaneously, in order to provide a shock front from one end colliding with the shock front to the opposite end within the pellet column at the center of the column length. On collision, the pressure is multiplied, at the point of collision, by about four to five times the normal pressure cited above. To achieve this result, the simultaneous firing of the bi directional detonation boosters 224, 226 can be timed precisely in order to assure collision within the explosive column at the center. In an alternative embodiment, the expansion tool 1 can include a detonation booster at only one end of the explosive pellet column, so that the explosive column is detonated from only the one end adjacent the detonation booster.

Toward the upper end of the guide tube 216, an adjustably positioned partition disc 220 can be secured by a set screw 221. Between the partition disc 220 and the inside face 238 of the top sub 212 can be a timing spool 222, as shown in FIG. 1. A first bi-directional booster 224 can be located inside of the guide tube bore 216 at the proximal end thereof. One end of the first bi-directional booster 224 may abut against a bulkhead formed as an initiation pellet 212*a*. The first bi-directional booster 224 can have enough explosive material to ensure the requisite energy to breach the bulkhead. The opposite end of the first bi-directional booster 224 can comprise a pair of mild detonating cords 230 and 232, which can be secured within detonation proximity to a small quantity of explosive material 225 (Sec FIG. 2). Detonation proximity is that distance between a particular detonator and a particular receptor explosive within which ignition of the detonator will initiate a detonation of the receptor explosive. The detonation cords 230 and 232 can have the same length so as to detonate opposite ends of the explosive column of pellets 240 at the same time. As shown in FIGS. 1 and 3, the first detonating cord 230 can continue along the guide tube 216 bore to be secured within a third hi-directional booster 226 that can be proximate of the explosive material 227. A first window aperture 234 in the wall of guide tube 216 can be cut opposite of the third bi directional booster 226, as shown. As shown in FIGS. 1 and 2, from the first bi-directional booster 224, the second detonating cord 232 can be threaded through a second window aperture 236 in the upper wall of guide tube 216 and around the helical surface channels of the timing spool 222. The timing spool, which is outside the cylindrical surface, can be helically channeled to receive a winding lay of detonation cord with insulating material separations between adjacent wraps of the cord. The distal end of second detonating cord 232 can terminate in a second bi-directional booster 228 that is set within a receptacle in the partition disc 220. The position of the partition disc 220 can be adjustable along the length of the guide tube 216 to accommodate the anticipated number of explosive pellets 240 to be loaded.

To load the dual end firing explosive column tool 1, the guide tube terminal 218 is removed along with the resilient spacers 242 (See FIG. 3). The pellets 240 of powdered, high explosive material, such as RDX, HMX or HNS, can be pressed into narrow wheel shapes. The pellets 240 may be coated/sealed, as discussed above. A central aperture can be provided in each pellet 240 to receive the guide tube 216 therethrough. Transportation safety may limit the total weight of explosive in each pellet 240 to, for example, less than 38.8 grams (600 grains) (1.4 ounces). When pressed to a density of about 1.6 g/cm$^3$ (0.92 oz/in$^3$) to about 1.65 g/cm$^3$ (0.95 oz/in$^3$), the pellet diameter may determine the pellet thickness within a determinable limit range.

The pellets 240 can be loaded serially in a column along the guide tube 216 length with the first pellet 240, in juxtaposition against the lower face of partition disc 220 and in detonation proximity with the second bi-directional booster 228. The last pellet 240 most proximate of the terminus 218 is positioned adjacent to the first window aperture 234. The number of pellets 240 loaded into the dual end firing explosive column tool 1 can vary along the length of the tool 1 in order to adjust the size of the shock wave that results from igniting the pellets 240. The length of the guide tube 216, or of the explosive column formed by the pellets, may depend on the calculations or testing discussed below. Generally, the expansion length of the wall of the tubular can be about two times the length of the column of explosive pellets 240. In testing performed by the inventor, a 19.1 centimeters (7.5 inch) column of pellets 240 resulted in an expansion length of the wall of a tubular of 40.6 centimeters (16 inches) (i.e., a ratio of column length to expansion length of 1 to 2.13). Any space remaining between the face of the bottom-most pellet 240 and the guide tube terminal 218 due to fabrication tolerance variations may be filled, e.g., with resilient spacers 242.

Figure 5:
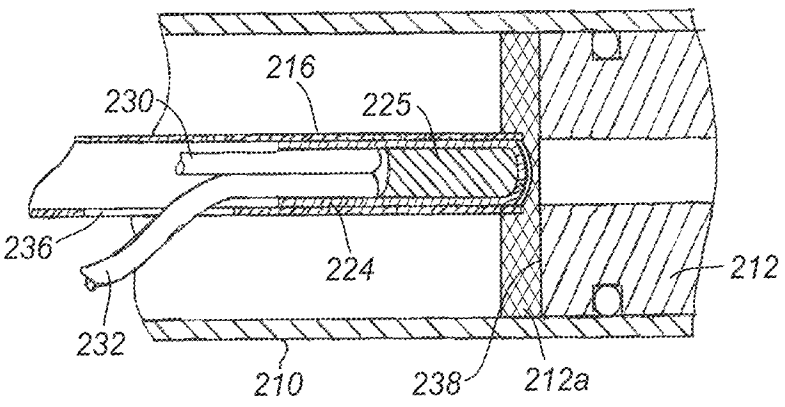
FIG. 5 is an enlargement of Detail A in FIG. 4.
Figure 6:
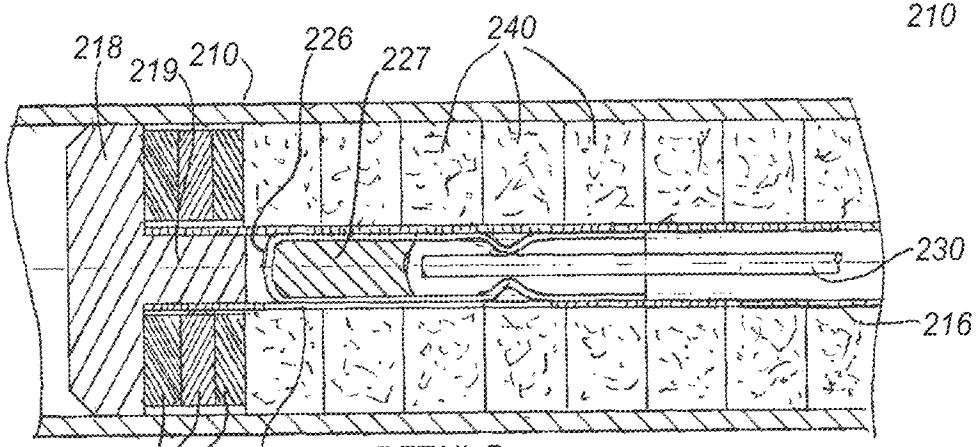
FIG. 6 is an enlargement of Detail B in FIG. 4.
Figure 4:
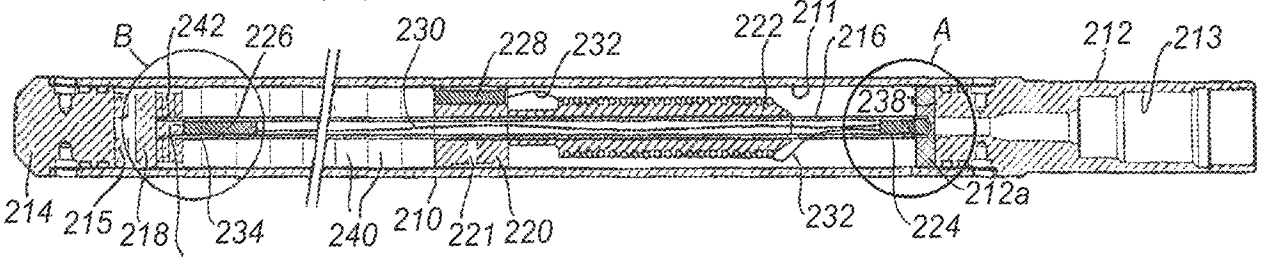
FIG. 4 is a cross-section of an embodiment of a dual end firing explosive column tool, as assembled for operation, for selectively expanding at least a portion of a wall of a tubular.

FIGS. 4-6 illustrate another embodiment of an expansion tool 1'. The expansion tool in this embodiment is a modified pressure bearing pellet tool, and differs from the modified pressure balanced pellet tool of FIGS. 1-3 in that the modified pressure bearing pellet tool 1' includes a housing 210 having an internal bore 211, in which the guide tube 216 and explosive pellets 240 are provided. The internal bore 211 can be sealed at its lower end by a bottom nose 214. The interior face of the bottom nose 214 can be cushioned with a resilient padding 215, such as a silicon foam washer. In other respects, the modified pressure bearing pellet tool 1' is similar to the modified pressure balanced pellet tool 1, and so like components are similarly labeled in FIGS. 4-6.

A method of selectively expanding at least a portion of the wall of a pipe or other tubular using the expansion tool described herein may be as follows. The expansion tool may be either the modified pressure balanced tool 1 of FIGS. 1-3, or the modified pressure bearing tool 1' of FIGS. 4-6. The expansion tool is assembled by arranging a predetermined number of explosive pellets 240 on the guide tube 216, which are to be in a serially-arranged column between the second and third bi-directional boosters 228, 226, so that the explosive pellets 240 are exposed to an outside of the expansion tool. The expansion tool is then positioned within a tubular T1 that is to be expanded, as shown in FIG. 7A.

Figure 7A:
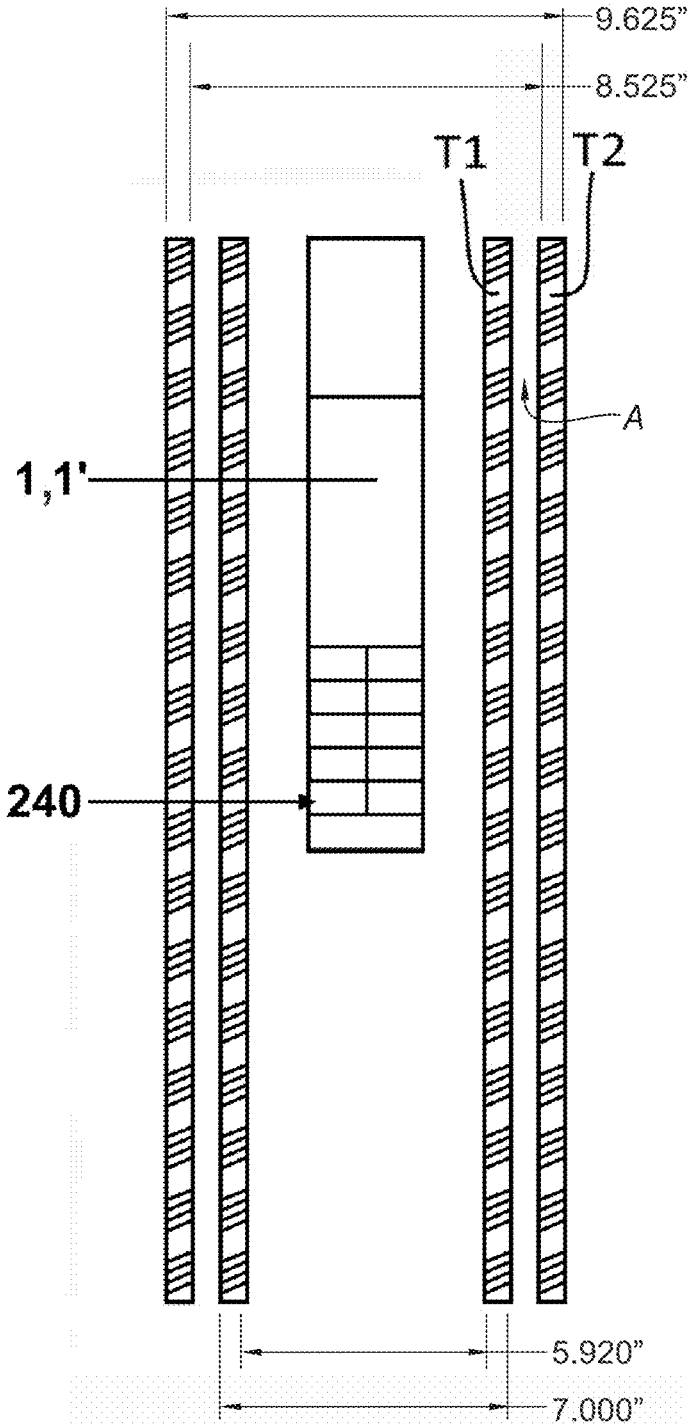
FIGS. 7A, 7B and FIG. 7C illustrate a method of selectively expanding at least a portion of the wall of a tubular using the dual end firing explosive column tool.
Figure 7B:
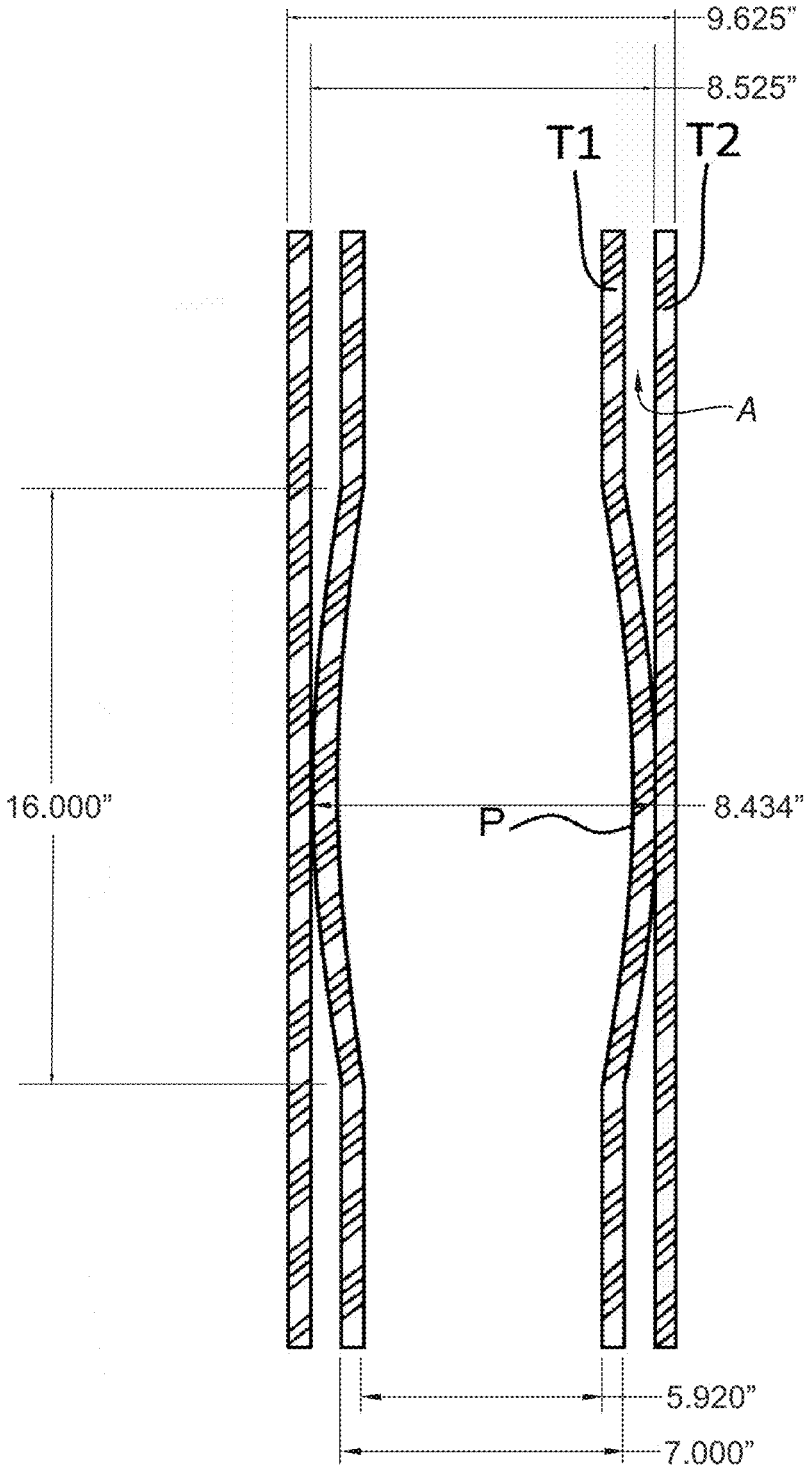
Figure 7C:
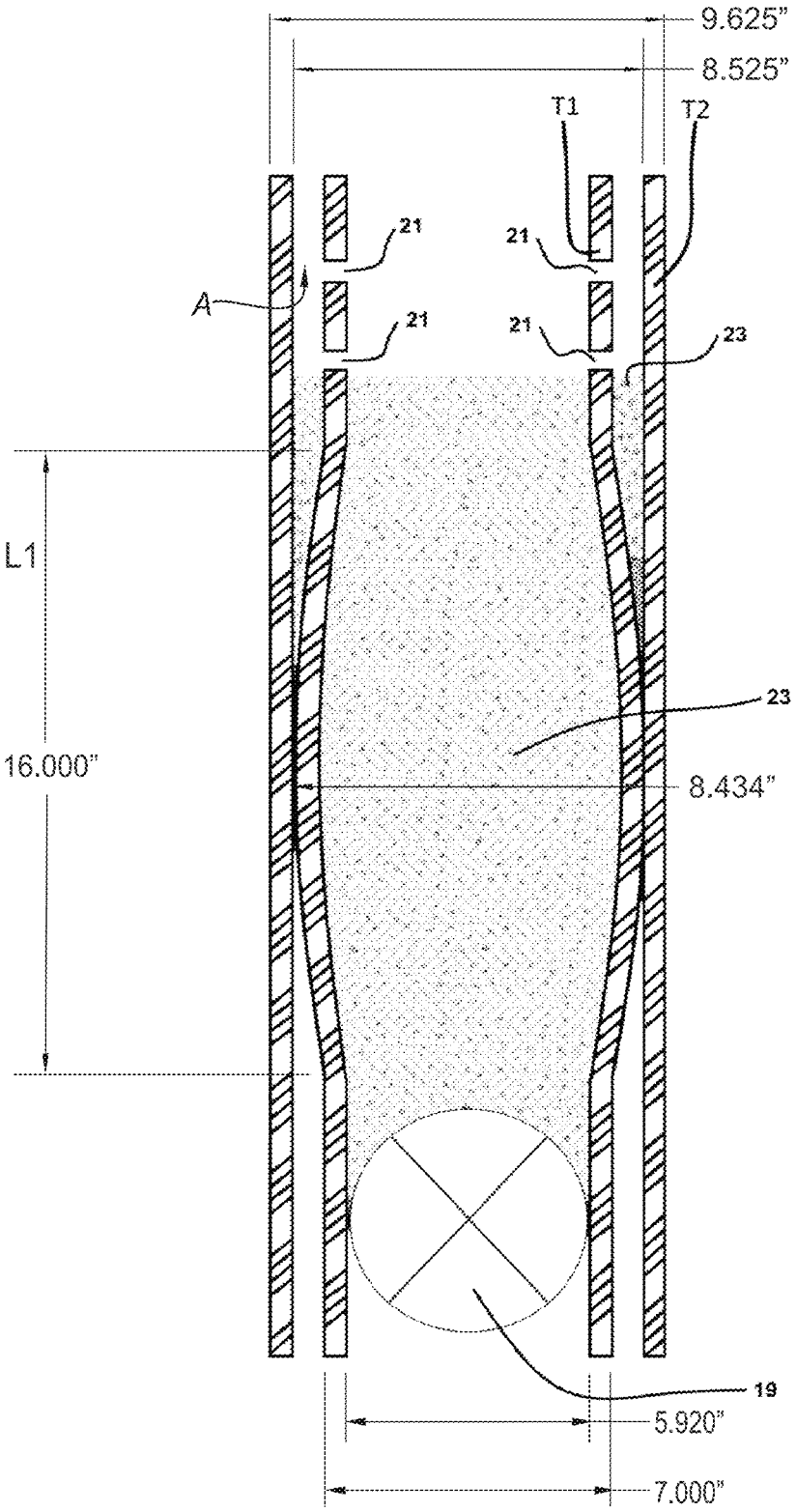

As shown in FIG. 7A, the tubular T1 may be an inner tubular that is located within an outer tubular T2, such that an annulus "A" is formed between the outer diameter of the inner tubular T1 and the inner diameter of the outer tubular 1'2. In some cases, the annulus "A" may contain material, such as cement, barite, other sealing materials, mud and/or debris. In other cases, the annulus "A" may not have any material therein. When the expansion tool 1, 1' reaches the desired location in the tubular T1, the bi-directional boosters 224, 226, 228 are detonated to simultaneously ignite opposing ends of the serially-arranged column of pellets 240 to form two shock waves that collide to create an amplified shock wave that travels radially outward to impact the inner tubular T1 at a first location, and expand at least a portion of the wall of the tubular T1 radially outward, as shown in FIG. 713, without perforating or cutting through the portion of the wall, to form a protrusion "P" of the tubular T1 at the portion of the wall. The protrusion "P" extends into the annulus "A" between an outer surface of the wall of the inner tubular T1 and an inner surface of a wall of the outer tubular 12. Mote that the pipe dimensions shown in FIGS. 7A to 7C are exemplary and for context, and are not limiting to the scope of the invention.

The protrusion "P" may impact the inner wall of outer tubular T2 after detonation of the explosive pellets 240. In some embodiments, the protrusion "P" may maintain contact with the inner wall of the outer tubular T2 after expansion is completed. In other embodiments, there may be a small space between the protrusion "P" and the inner wall of the outer tubular 12. Expansion of the tubular T1 at the protrusion "P" can cause that portion of the wall of the tubular T1 to be work-hardened, resulting in greater strength of the wall at the protrusion "P". Embodiments of the methods of the present invention show that the portion of the wall having the protrusion "P" is not weakened. In particular, the yield strength of the tubular T1 increases at the protrusion "P", while the tensile strength of the tubular T1 at the protrusion "P" decreases only nominally. Therefore, according to these embodiments, expansion of the tubular T1 at the protrusion "P" thus strengthens the tubular without breaching the tubular T1.

The magnitude of the protrusion "P" can depend on several factors, including the length of the column of explosive pellets 240, the outer diameter of the explosive pellets 240, the amount of explosive material in the explosive pellets 240, the type of explosive material, the strength of the tubular T1, the thickness of the wall of the tubular T1, the hydrostatic force bearing on the outer diameter of the tubular T1, and the clearance adjacent the tubular T1 being expanded, i.e., the width of the annulus "A" adjacent the tubular T1 that is to be expanded.

One way to manipulate the magnitude of the protrusion "P" is to control the amount of explosive force acting on the pipe or other tubular member T1. This can be done by changing the number of pellets 240 aligned along the guide tube 216. For instance, the explosive force resulting from the ignition of a total of ten pellets 240 is larger than the explosive force resulting from the ignition of a total of five similar pellets 240. As discussed above, the length "L1" (see FIG. 7C) of the expansion of the wall of the tubular T1 may be about two times the length of the column of explosive pellets 240. Another way to manipulate the magnitude of the protrusion "P" is to use pellets 240 with different outside diameters. The expansion tool discussed herein can be used with a variety of different numbers of pellets 240 in order to suitably expand the wall of pipes or other tubular members of different sizes. Determining a suitable amount of explosive force (e.g., the number of pellets 240 to be serially arranged on the guide tube 216), to expand the wall of a given tubular T1 in a controlled manner, can depend on a variety of factors, including: the length of the column of explosive pellets 240, the outer diameter of the explosive pellets 240, the material of the tubular T1, the thickness of a wall of the tubular T1, the inner diameter of the tubular T1, the outer diameter of the tubular T1, the hydrostatic force bearing on the outer diameter of the tubular T1, the type of the explosive (e.g., HMX, HNS) and the desired size of the protrusion "P" to be formed in the wall of the tubular T1.

The above method of selectively expanding at least a portion of a wall of the tubular T1 via an expansion toot may be modified to include determining the following characteristics of the tubular T1: a material of the tubular T1; a thickness of a wall of the tubular T1; an inner diameter of the tubular T1; an outer diameter of the tubular T1; a hydrostatic force bearing on the outer diameter of the tubular T1; and a size of a protrusion "P" to be formed in the wall of the tubular T1. Next, the explosive force necessary to expand, without puncturing, the wall of the tubular T1 to form the protrusion "P", is calculated, or determined via testing, based on the above determined material characteristics.

The determinations and calculation of the explosive force can be performed via a software program, and providing input, which can then be executed on a computer. Physical hydrostatic testing of the explosive expansion charges yields data which may be input to develop computer models. The computer implements a central processing unit (CPU) to execute steps of the program. The program may be recorded on a computer-readable recording medium, such as a CD-ROM, or temporary storage device that is removably attached to the computer. Alternatively, the software program may be downloaded from a remote server and stored internally on a memory device inside the computer. Based on the necessary force, a requisite number of explosive pellets 240 to be serially added to the guide tube 216 of the expansion tool is determined. The requisite number of explosive pellets 240 can be determined via the software program discussed above.

The requisite number of explosive pellets 240 is then serially added to the guide tube 216. After loading, the loaded expansion tool can be positioned within the tubular T1, with the last pellet 240 in the column being located adjacent the detonation window 234. Next, the expansion tool can be actuated to ignite the pellets 240, resulting in a shock wave as discussed above that expands the wall of the tubular T1 radially outward, without perforating or cutting through the wall, to form the protrusion "P". The protrusion "P" can extend into the annulus "A" between an outer surface of the tubular T1 and an inner surface of a wall of another tubular 12.

In a test conducted by the inventors using the dual end firing explosive column tool 1 on a pipe having a 6.4 centimeter (2.5 inch) wall thickness, an inner diameter of 22.9 centimeters (9.0 inches) and an outer diameter of 35.6 centimeters (14.0 inches), resulted in radial protrusion measuring 45.7 centimeters (18.0 inches) in diameter. That is, the outer diameter of the pipe increased from 35.6 centimeters (14.0 inches) to 45.7 centimeters (18.0 inches) at the protrusion. The protrusion is a gradual expansion of the wall of the tubular T1. The more gradual expansion allows a greater expansion of the tubular T1 prior to exceeding the elastic strength of the tubular T1, and failure of the tubular T1 (i.e., the tubular being breeched).

The column of explosive pellets 240 comprises a predetermined (or requisite) amount of explosive material sufficient to expand at least a portion of the wall of the pipe or other tubular into a protrusion extending outward into an annulus adjacent the wall of the pipe or other tubular. It is important to note that the expansion can be a controlled outward expansion of the wall of the pipe or other tubular, which does not cause puncturing, breaching, penetrating or severing of the wall of the pipe or other tubular. The annulus may be reduced between an outer surface of the wall of the pipe or other tubular and an outer wall of another tubular or a formation.

The protrusion "P" creates a ledge or barrier into the annulus that helps seal that portion of the wellbore during plug and abandonment operations in an oil well. For instance, a sealant, such as cement or other sealing material, mud and/or debris, may exist in the annulus "A" on the ledge or barrier created by the protrusion "P". The embodiments above involve using one column of explosive pellets 240 to selectively expand a portion of a wall of a tubular into the annulus. One option is to use two or more columns of explosive pellets 240. The explosive columns may be spaced at respective expansion lengths which, as noted previously, can vary as a function of the length of the explosive column unique to each application. After the first protrusion is formed by the first explosive column, the additional explosive column is detonated at a desired location, to expand the wall of the tubular T1 at a second location that is spaced from the first location and in a direction parallel to an axis of the expansion tool, to create a pocket outside the tubular T1 between the first and second locations. The pocket is thus created by sequential detonations of explosive columns. In another embodiment, the pocket may be formed by simultaneous detonations of explosive columns. For instance, two explosive columns may be spaced from each other at first and second locations, respectively, along the length of the tubular T1. The two explosive columns are detonated simultaneously at the first and second locations to expand the wall of the tubular T1 at the first and second locations to create the pocket outside the tubular T1, between the first and second locations.

Whether one or multiple columns of explosive pellets 240 are utilized, the method may further include setting a plug 19 below the deepest selective expansion zone, and then shooting perforating puncher charges through the wall of the inner tubular T1 above the top of the shallowest expansion zone, so that there can be communication ports 21 from the inner diameter of the inner tubular T1 to the annulus "A" between the inner tubular T1 and the outer tubular 12, as shown in FIG. 7C. Cement 23, or other sealing material, may then be pumped to create a seal in the inner diameter of the inner tubular T1 and in the annulus "A" through the communication ports 21 between the inner tubular T1 and the outer tubular T2, as shown in FIG. 7C. The cement 23 is viscus enough that, even if there is only a ledge/restriction (formed by the protrusion P1), the cement 23 should be slowed down long enough to set up and seal. When the cement 23 is pumped into the annulus "A", any and all material. (e.g., cement, mud, debris), will likely help effect the seal. One reason multiple columns of explosive pellets 240 may be used is the hope that if a seal is not achieved in the annulus "A" at the first ledge/restriction (formed by the protrusion P1), the seal may be provided by the additional ledge/restriction (formed by the additional protrusion), if the seal in the annulus "A" cannot be effected, the operator must cut the inner tubular T1 and retrieve it to the surface, and then go through the same plug and pump cement procedure for the outer tubular T2. Those procedures can be expensive.

Transporting and storing the explosive units may be hazardous. There are thus safety guidelines and standards governing the transportation and storage of such. One of the ways to mitigate the hazards associated with transporting and storing the explosive units is to divide the explosive units into smaller component pieces. The smaller component pieces may not pose the same explosive risk during transportation and storage as a full-size unit may have. Each of the explosive pellets 240 discussed herein may thus be transported and/or stored separately (from the expansion tool, and may be spaced from each other in a carton.

Figure 8:
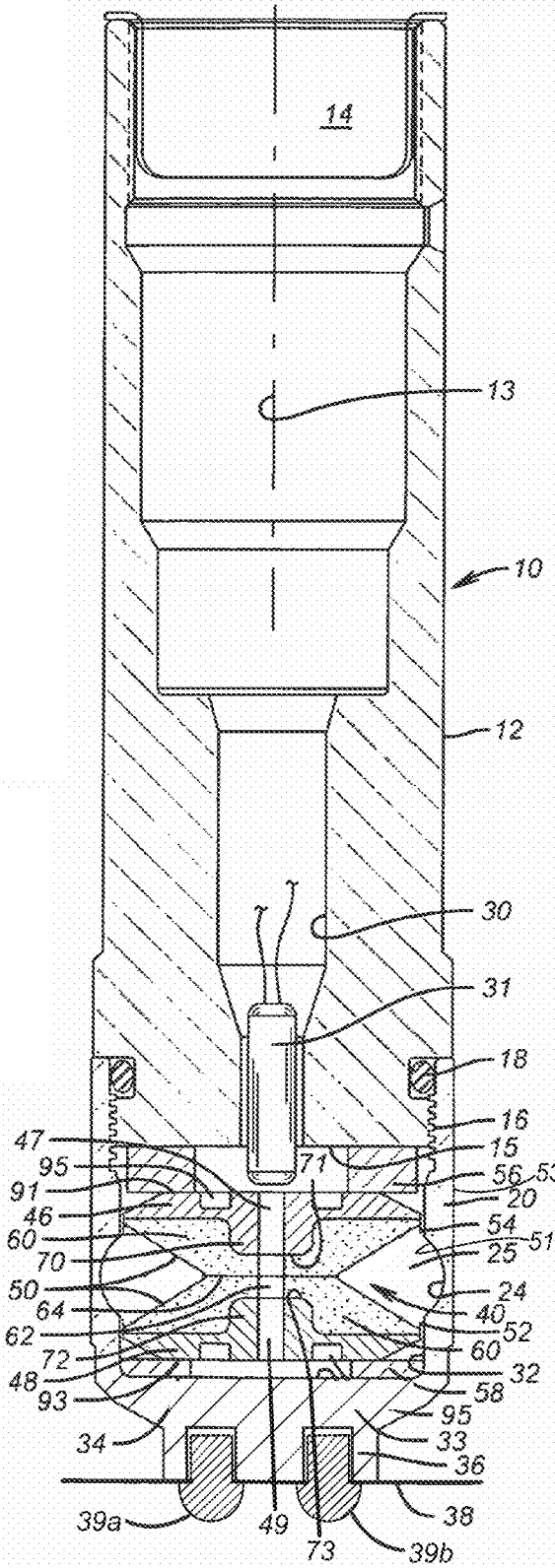
FIG. 8 is a cross-section of an embodiment of a tool, including a shaped charge assembly, for selectively expanding at least a portion of a wall of a tubular.

FIG. 8 shows an alternative tool 10 for selectively expanding at least a portion of a wall of a tubular. The tool 10 is a liner-less shaped charge tool. The tool 10, as shown, can comprise a top sub 12 having a threaded internal socket 14 that can axially penetrate the "upper" end of the top sub 12. The socket thread 14 can provide a secure mechanism for attaching the tool 10 with an appropriate wire line or tubing suspension string (not shown). The tool 10 may have a substantially circular cross-section. The outer configuration of the tool 10 may thus be substantially cylindrical. The "lower" end of the top sub 12 can include a substantially flat end face 15, as shown. The flat end face 15 perimeter can be delineated by a housing assembly thread 16 and an O-ring seal 18. The axial center 13 of the top sub 12 can be bored between the assembly socket 14 and the end face 15 to provide a socket 30 for an explosive detonator 31. In some embodiments, the detonator may comprise a hi-directional booster with a detonation cord.

A housing 20 can be secured to the top sub 12 by, for example, an internally threaded sleeve 22. The O-ring 18 can be used to seal the interface from fluid invasion of the interior housing volume. A window section 24 of the housing interior is an inside wall portion of the housing 20 that bounds a cavity 25 around the shaped charge between the outer or base perimeters 52 and 54. The upper and lower limits of the window 24 can be coordinated with the shaped charge dimensions to place the window "sills" at the approximate mid-line between the inner and outer surfaces of the explosive material 60. The housing 20 may be a frangible steel material of approximately 55-60 Rockwell "C" hardness.

Below the window 24, the housing 20 can be internally terminated by an integral end wall 32 having a substantially flat internal end-face 33. The external end-face 34 of the end wall may be frusto-conical about a central end boss 36. A hardened steel centralizer assembly 38 may be secured to the end boss by assembly bolts 39*a*, 39*b*, wherein each blade of the centralizer assembly 38 is secured with a respective one of the assembly bolts 39*a*, 39*b* (i.e., each blade has its own assembly bolt).

A shaped charge assembly 40 can be spaced between the top sub end face 15 and the internal end-face 33 of the housing 20 by a pair of resilient, electrically non-conductive, ring spacers 56 and 58. In some embodiments, the ring spacers may comprise silicone sponge washers. An air space of at least 0.254 centimeters (0.1 inches) is preferred between the top sub end face 15 and the adjacent face of a back up plate 46. Similarly, a resilient, non conductive lower ring spacer 58 (or silicone sponge washer) provides an air space that is preferably at least 0.254 centimeters (0.1 inches) between the internal end-face 33 and an adjacent assembly lower end plate 48.

Loose explosive particles can be ignited by impact or friction in handling, bumping or dropping the assembly. Ignition that is capable of propagating a premature explosion may occur at contact points between a steel, shaped charge back up plate 46 or end plate 48 and a steel housing 20. To minimize such ignition opportunities, the back up plate 46 and lower end plate 48 are preferably fabricated of non-sparking brass.

Figure 16:
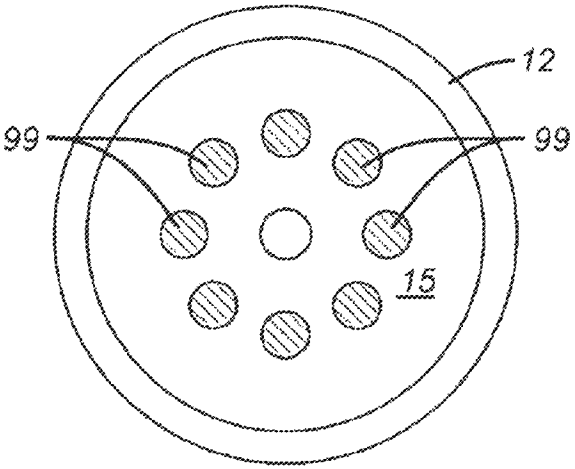
FIG. 16 is a bottom plan view of an embodiment of a top sub after detonation of the explosive material.
Figure 14:
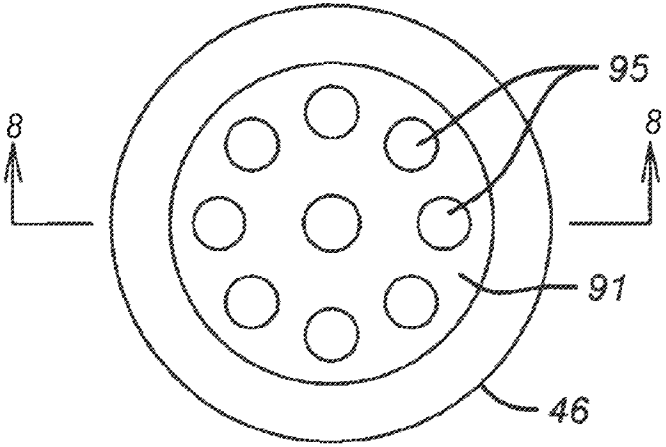
FIG. 14 is a plan view of an embodiment of an end plate showing marker pocket borings.
Figure 15:
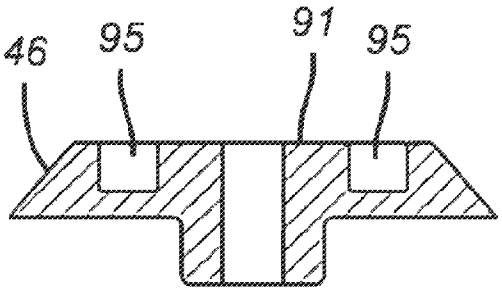
FIG. 15 is a cross-section view of the end plate along plane 8-8 of FIG. 14.

The outer faces 91 and 93 of end plates 46 and 48 (back up plates), as respectively shown by FIGS. 8 and 14-16, are blind bored with marker pockets 95 in a prescribed pattern, such as a circle with uniform arcuate spacing between adjacent pockets, as illustrated by FIGS. 14 and 15. The pockets 95 in the outer face 91, 93 can be shallow surface cavities that are stopped short of a complete aperture through the end plates to form selectively weakened areas of the end plates. When the explosive material 60 detonates, the marker pocket walls are converted to jet material. The jet of fluidized end plate material can scar the lower end face 15 of the top sub 12 with impression marks 99 in a pattern corresponding to the original pockets, as shown by FIG. 16. When the top sub 12 is retrieved after detonation, the uniformity and distribution of these impression marks 99 reveal the quality and uniformity of the detonation and hence, the quality of the explosion. For example, if the top sub face 15 is marked with only a half section the end plate pocket pattern, it may be reliability concluded that only half of the explosive material 60 correctly detonated.

The explosive material units 60 traditionally used in the composition of shaped charge tools comprises a precisely measured quantity of powdered, high explosive material, such as RDX, HNS or HMX. The explosive material can be formed into units 60 shaped as a truncated cone by placing the explosive material in a press mold fixture. A precisely measured quantity of powdered explosive material, such as RDX, HNS or HMX, can be distributed within the internal cavity of the mold. Using a central core post as a guide mandrel through an axial aperture 47 in the upper back up plate 46, the backup plate is placed over the explosive powder and the assembly subjected to a specified compression pressure. This pressed lamination comprises a half section of the shaped charge assembly 40.

The lower half section of the shaped charge assembly 40 may be formed in the same manner as described above, having a central aperture 62 of about 032 centimeter (0.125 inch) diameter in axial alignment with back up plate aperture 47 and the end plate aperture 49. A complete assembly comprises the contiguous union of the lower and upper half sections along the juncture plane 64. Notably, the backup plate 46 and end plate 48 can be each fabricated around respective annular boss sections 70 and 72 that provide a protective material mass between the respective apertures 47 and 49 and the explosive material 60. These bosses can be terminated by distal end faces 71 and 73 within a critical initiation distance of about 0.13 centimeters (0.050 inches) to about 0.254 centimeters (0.1 inches) from the assembly juncture plane 64. Hence, the explosive material 60 is insulated from an ignition wave issued by the detonator 31 until the wave arrives in the proximity of the juncture plane 64.

The apertures 47, 49 and 62 for the FIG. 8 embodiment remain open and free of boosters or other explosive materials. Although an original explosive initiation point for the shaped charge assembly 40 only occurs between the boss end faces 71 and 73, the original detonation event is generated by the detonator 31 outside of the backup plate aperture 47. The detonation wave can be channeled along the empty backup plate aperture 47 to the empty central aperture 62 in the explosive material. Typically, an explosive load quantity of 38.8 gins (1.4 ounces) of HMX compressed to a loading pressure of 20.7 Mpa (3,000) psi may require a moderately large detonator 31 of 420 milligrams (0.03 ounces) HMX for detonation.

The FIG. 8 embodiment obviates any possibility of orientation error in the field while loading the housing 20. A detonation wave may be channeled along either boss aperture 47 or 49 to the explosive material 60 around the central aperture 62. Regardless of which orientation the shaped charge assembly 40 is given when inserted in the housing 20, the detonator 31 will initiate the explosive material 60.

Absent from the explosive material units 60 is a liner that is conventionally provided on the exterior surface of the explosive material and used to cut through the wall of a tubular. Instead, the exterior surface of the explosive material is exposed to the inner surface of the housing 20. Specifically, the housing 20 comprises an outer surface 53 facing away from the housing 20 and an opposing inner surface 51 facing an interior of the housing 20. The explosive units 60 each comprise an exterior surface 50 facing the inner surface 51 of the housing 20, and the exterior surface 50 is exposed to the inner surface 51 of the housing 20. Describing that the exterior surface 50 of the explosive units 60 is exposed to the inner surface 51 of the housing 20 is meant to indicate that the exterior surface 50 of the explosive units 60 is not provided with a liner, as is the case in conventional cutting devices.

The explosive units 60 comprise a predetermined amount of explosive material sufficient to expand at least a portion of the wall of the tubular into a protrusion extending outward into an annulus adjacent the wall of the tubular. For instance, testing conducted with a 72 gram HMX, 6.8 centimeter (2.690 inch) outer diameter expansion charge on a tubular having a 11.4 centimeter (4.500 inch) outer diameter and a 10.11 centimeter (3.978 inch) inner diameter resulted, during testing, in expanding the outer diameter of the tubular to 13.5 centimeters (5.316 inches). The expansion was limited to a 10.2 centimeter (4 inch) length along the outer diameter of the tubular. It is important to note that the expansion is a controlled outward expansion of the wall of the tubular, and does not cause puncturing, breaching, penetrating or severing of the wall of the tubular. The annulus may be formed between an outer surface of the wall of the tubular and an outer wall of another tubular or a formation. Cement located in the annulus can be compacted by the protrusion, thus reducing the number of micro-pores in the cement, or other voids, and thus reducing the porosity of the cement, or other sealing agents. The reduced-porosity cement provides a better seal against annulus flow that would otherwise lead to cracks, decay and/or contamination of the cement, casing and wellbore. Further, compacting the cement in the annulus may collapse and/or compress open channels, sometimes referred to as "channel columns" that undesirably allow gas and/or fluids to flow through the cemented annulus, thus raising the risk of cracks, decay and/or contamination of the cement and the wellbore. In other situations, compacting the cement in the annulus may reduce the number of inconsistencies or other defects in the cement that adversely affect the seal. Cement inconsistency may arise when the cement is inadvertently not provided around the entire 360 degree circumference of the casing. This may occur especially in horizontal wells, where gravity acts on the cement above the casing in the horizontal wellborn. Further, shifts in the strata (formation) of the earth may cause cracks in the cement, resulting in "channel columns" in the cement where annulus flow would otherwise not occur. Other inconsistencies or defects of the cement in the annulus may arise from inconsistent viscosity of the cement, contamination of the cement and/or from a pressure differential in the formation that causes the cement to be inconsistent in different areas of the annulus.

A method of selectively expanding at least a portion of the wall of a tubular using the tool 10 described herein can include: assembling the tool 10, including the housing 20 containing explosive material 60, adjacent two end plates 46, 48 on opposite sides of the explosive material 60. As discussed above, the housing 20 can comprise an inner surface 51 facing an interior of the housing 20, and the explosive material 60 can comprise an exterior surface 50 that faces the inner surface 51 of the housing 20 and is exposed to the inner surface 51 of the housing 20 (i.e., there is no liner un the exterior surface 50 of the explosive material 60).

Figure 9A:
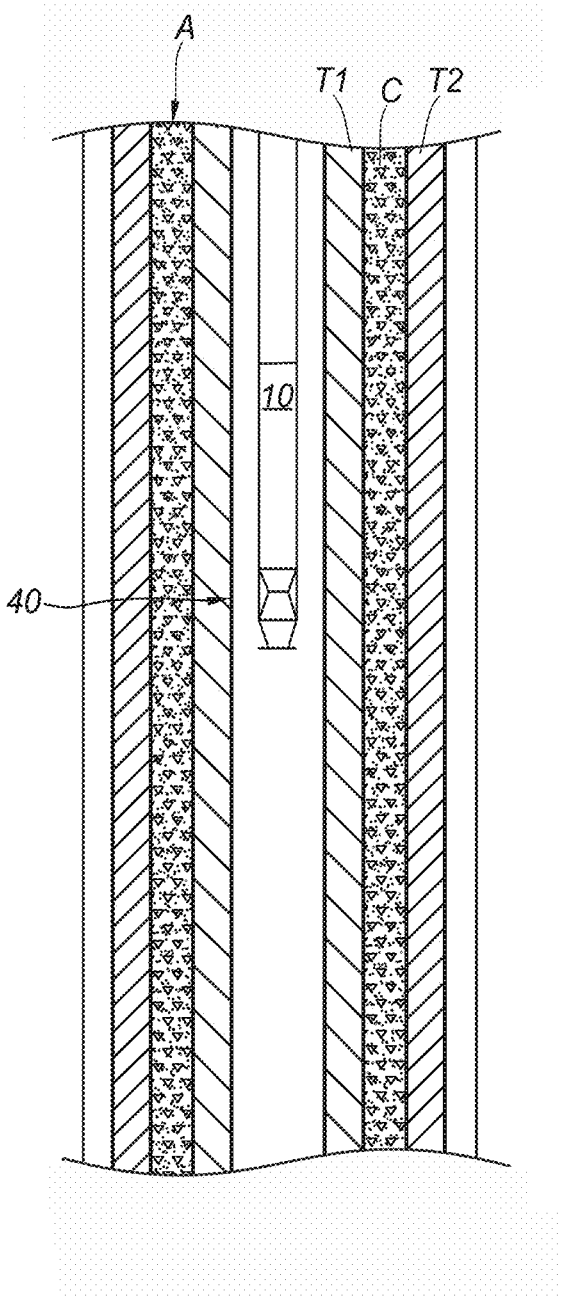
FIG. 9A and FIG. 9B illustrate a method of selectively expanding at least a portion of the wall of a tubular using the shaped-charge tool.
Figure 9B:
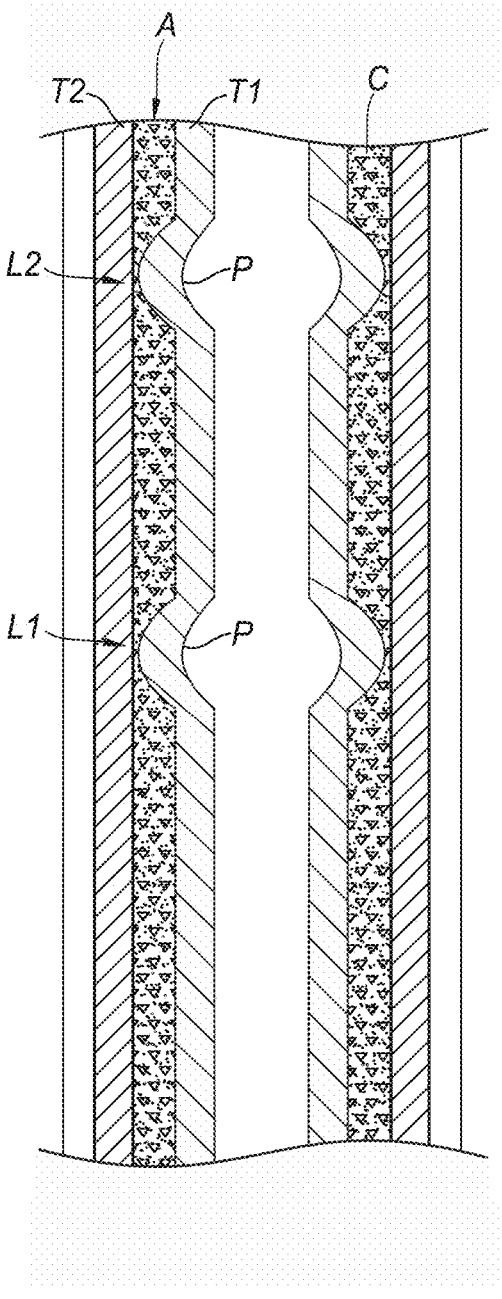

A detonator 31 (see FIG. 8) can be positioned adjacent to one of the two end plates 46, 48. The tool 10 can then be positioned within a tubular T1 that is to be expanded, as shown in FIG. 9A. When the tool 10 reaches the desired location in the tubular T1, the detonator 31 can be actuated to ignite the explosive material 60, causing a shock wave that travels radially outward to impact the tubular T1 at a first location L1 (see FIG. 9B) and expand at least a portion of the wall of the tubular T1 radially outward without perforating or cutting through the portion of the wall, to form a protrusion "P" of the tubular T1 at the portion of the wall. The protrusion "P" can extend into an annulus "A," between an outer surface of the wall of the tubular T1 and an inner surface of a wall of another tubular T2. The protrusion "P" creates a ledge or barrier that helps seal that portion of the wellbore during plug and abandonment operations in an oil well. For instance, a sealant, such as cement "C", or other material, such as mud and/or debris, may exist in the annulus "A" on the ledge or barrier created by the protrusion "P".

Figure 10A:
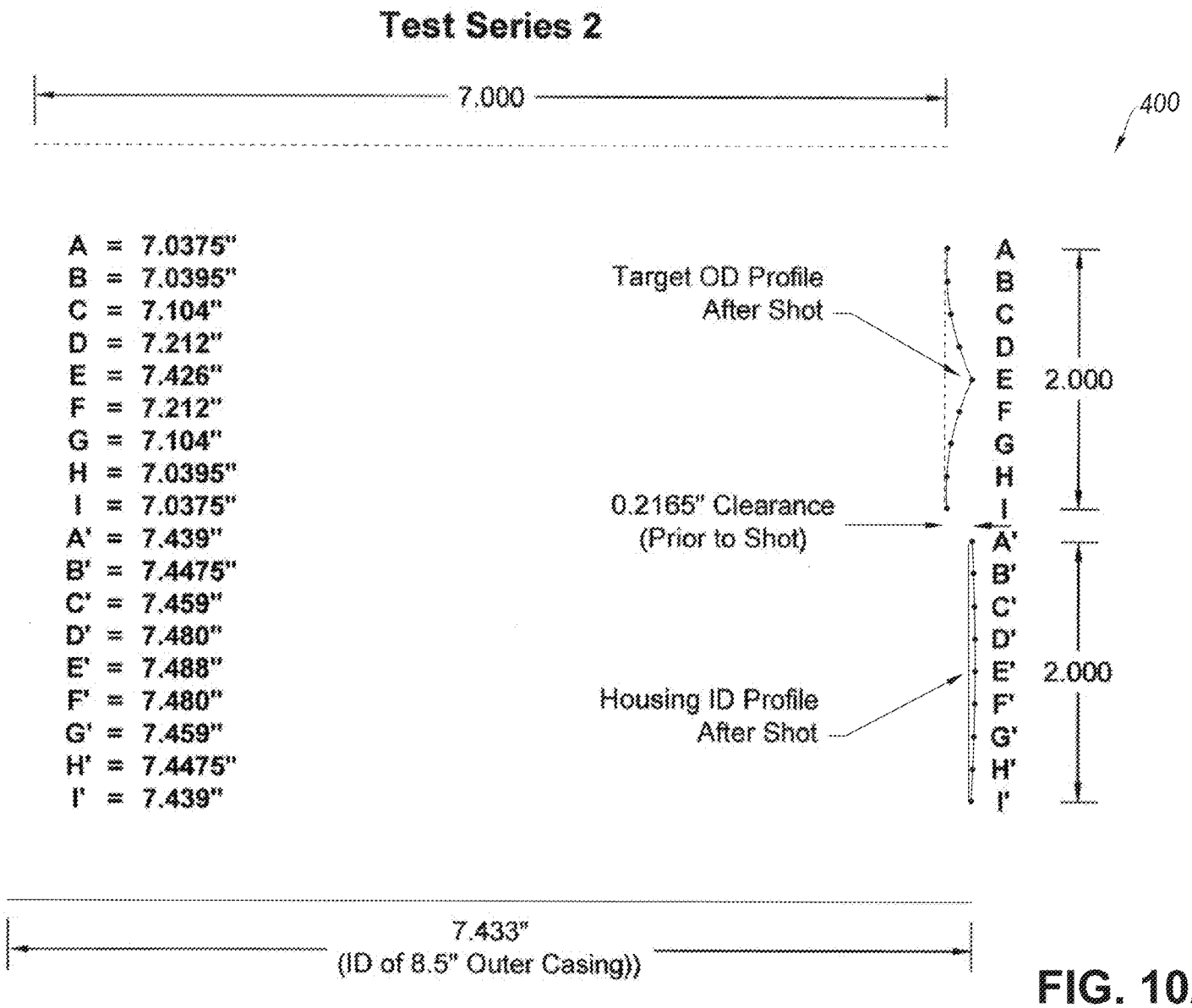
FIG. 10A and FIG. 10B illustrate graphs showing swell profiles resulting from tests of a pipe and an outer housing.
Figure 10B:
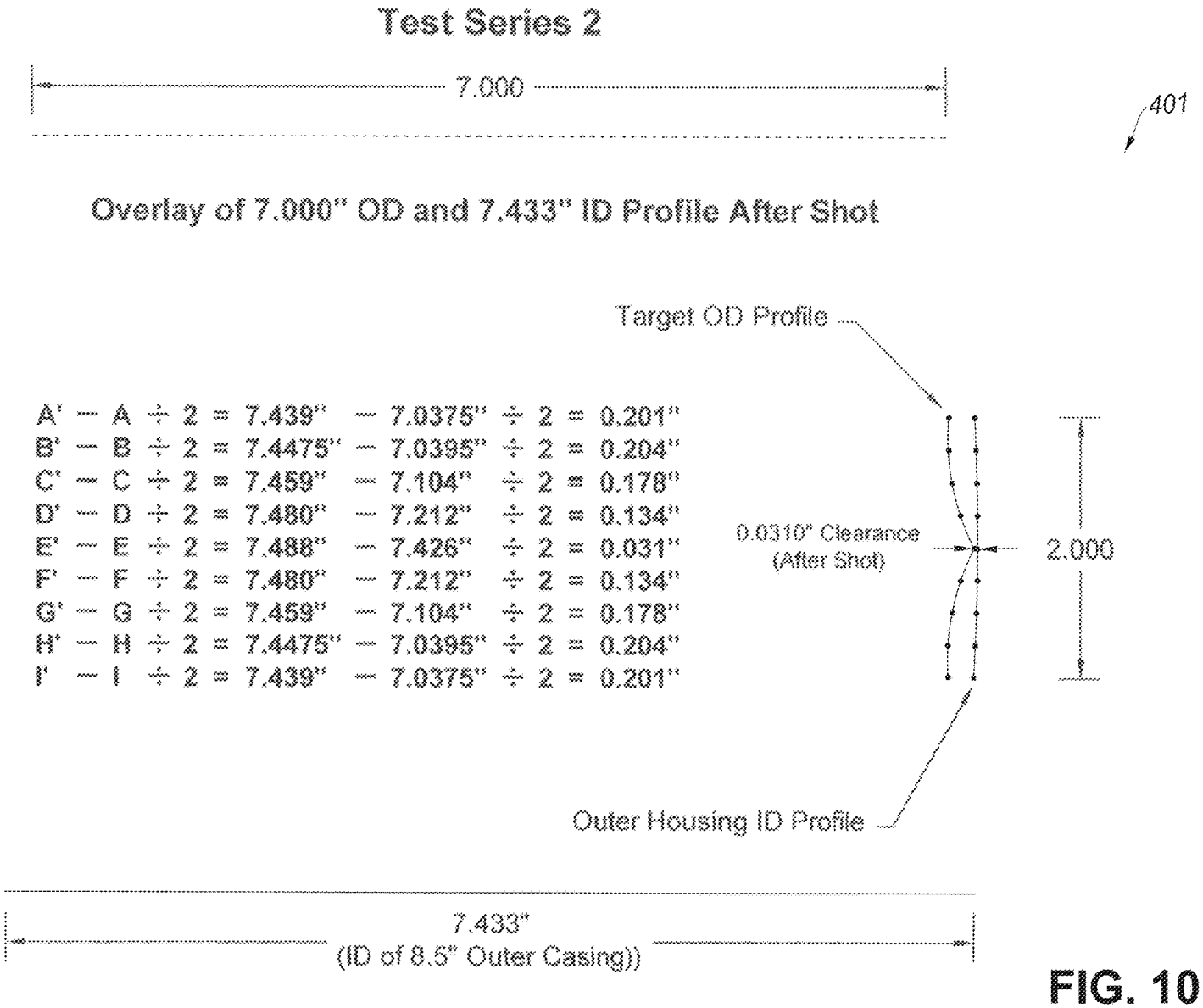

The protrusion "P" may impact the inner wall of other tubular T2 after detonation of the explosive material 60. In some embodiments, the protrusion "P" may maintain contact with the inner wall of the other tubular T2 after expansion is complete. In other embodiments, there may be a small space between the protrusion "P" and the inner wall of the other tubular 12. For instance, the embodiment of FIG. 10B shows that the space between the protrusion "P" and the inner wall of the outer tubular 12 may be 0.079 centimeters (0.0310 inches). However, the size of the space will vary depending on several factors, including, but not limited to: size (e.g., thickness) of the inner tubular T1, strength and material of the inner tubular T1, type and amount of the explosive material in the explosive units 60, physical profile of the exterior surface 50 of the explosive units 60, the hydrostatic pressure bearing on the inner tubular T1, desired size of the protrusion, and nature of the wellbore operation. The small space between the protrusion "P" and the inner wall of the other tubular 12 may still be effective for blocking flow of cement, barite, other sealing materials, drilling mud, etc., so long as the protrusion "P" approaches the inner diameter of the outer tubular T2. This is because the viscosity of those materials generally prevents seepage through such a small space. Expansion of the tubular T1 at the protrusion "P" can cause that portion of the wall of the tubular T1 to be work-hardened, resulting in greater strength of the wall at the protrusion "P." Embodiments of the methods described herein show that the portion of the wall having the protrusion "P" is not weakened. In particular, the yield strength of the tubular T1 increases at the protrusion "P", while the tensile strength of the tubular T1 at the protrusion "P" decreases only nominally. Therefore, these embodiments include that the expansion of the tubular T1 at the protrusion "P" strengthens the tubular without breaching the tubular T1.

The magnitude of the protrusion depends on several factors, including the amount of explosive material in the explosive units 60, the type of explosive material, the physical profile of the exterior surface 50 of the explosive units 60, the strength of the tubular T1, the thickness of the tubular wall, the hydrostatic pressure bearing on the inner tubular T1, and the clearance adjacent the tubular being expanded, i.e., the width of the annulus "A" adjacent the tubular that is to be expanded. In the embodiment of FIG. 8, the physical profile of the exterior surface 50 of the explosive units 60 is shaped as a side-ways "V". The angle at which the legs of the "V" shape intersect each other may be varied to adjust the size and/or shape of the protrusion. Generally, a smaller angle will generate a larger protrusion "P". Alternatively, the physical profile of the exterior surface 50 may be curved to define a hemispherical shape.

The method of selectively expanding at least a portion of the wall of a tubular T1 using the shaped charge tool 10 described herein may be modified to include determining the following characteristics of the tubular T1: a material of the tubular T1; a thickness of a wall of the tubular T1; an inner diameter of the tubular T1; an outer diameter of the tubular T1; a hydrostatic force bearing on the outer diameter of the tubular T1; and a size of a protrusion "P" to be formed in the wall of the tubular T1.

The explosive force necessary to expand, without puncturing, the wall of the tubular T1 to form the protrusion "P", can be calculated, or determined via testing, based on the above determined material characteristics. As discussed above, the determinations and calculation of the explosive force can be performed via a software program executed on a computer. Physical hydrostatic testing of the explosive expansion charges yields data which may be input to develop computer models. The computer implements a central processing unit (CPU) to execute steps of the software program. The program may be recorded on a computer-readable recording medium, such as a CD-ROM, or temporary storage device that is removably attached to the computer. Alternatively, the software program may be downloaded from a remote server and stored internally on a memory device inside the computer. Based on the necessary force, a requisite amount or explosive material for the one or more explosive material units 60 to be added to the shaped charge tool 10 is determined. The requisite amount of explosive material can be determined via the software program discussed above.

The one or more explosive material units 60 having the requisite amount of explosive material is added to the shaped charge tool 10. The loaded shaped charge tool 10 can then be positioned within the tubular T1 at a desired location. Next, the shaped charge tool 10 can be actuated to detonate the one or more explosive material units 60, resulting in a shock wave as discussed above that expands the wall of the tubular T1 radially outward, without perforating or cutting through the wall, to form the protrusion "P." The protrusion "P" can extend into the annulus "A" adjacent an outer surface of the wall of the tubular T1.

A first series of tests was conducted to compare the effects of sample explosive units 60 not having a liner with a comparative explosive unit that included a liner on the exterior surface thereof. The explosive units in the first series had 15.88 centimeter (6.250 inch) outer housing diameter, and were each tested separately in a respective 17.8 centimeter (7.0 inch) outer diameter test pipe. The test pipe had a 16 centimeter (6.300 inch) inner diameter, and a 0.889 centimeter (0.350 inch) Wall Thickness, L-80.

The comparative sample explosive unit had a 15.88 centimeter (6.250 inch) outside housing diameter and included liners. Silicone caulk was added to fowl the liners, leaving only the outer 0.76 centimeter (0.3 inch) of the liners exposed for potential jetting. 77.6 grams (2.7 ounces) of HMX main explosive was used as the explosive material. The sample "A" explosive unit had a 15.9 centimeter (6.250 inch) outside housing diameter and was free of any liners. 155.6 grams (5.5 ounces) of HMX main explosive was used as the explosive material. The sample "B" explosive unit had a 15.9 centimeter (6.250 inch) outside housing diameter and was free of any liners. 122.0 grams (4.3 ounces) of HMX main explosive was used as the explosive material.

The test was conducted at ambient temperature with the following conditions. Pressure: 20.7 Mpa (3,000 psi). Fluid: water. Centralized Shooting Clearance: 0.06 centimeter (0.025 inch). The Results are provided below in Table 1.

TABLE 1

Test Summary in 17.8 centimeters (7 inch) O.D. × 0.89 centimeters (0.350 inch) wall L-80

| Sample | Main Load MMX (grams) (ounces) | Swell (centimeter) (inches) |
|---|---|---|
| Comparative (with liner) | 77.6 g (2.7 oz) | 18.5 cm (7.284 inches) |
| A | 155.6 g (5.5 oz) | 19.3 cm (7.6 inches) |
| B | 122.0 g (4.3 oz) | 18.6 cm (7.317 inches) |

The comparative sample explosive unit produced a 18.5 cm (7.284 inches) swell, but the jetting caused by the explosive material and liners undesirably penetrated the inside diameter of the test pipe. Samples "A" and "B" resulted in 19.3 cm (7.6 inches) and 18.6 cm (7.317 inches) swells (protrusions), respectively, that were smooth and uniform around the inner diameter of the test pipe.

A second test was performed using the Sample "A" explosive unit in a test pipe having similar properties as in the first series of tests, but this time with an outer housing outside the test pipe to see how the character of the swell in the test pipe might change and whether a seal could be effected between the test pipe and the outer housing. The test pipe had a 17.8 centimeter (7 inch) outer diameter, a 16.1 centimeter (6.32 inch) inner diameter, a 0.86 centimeter (0.34 inch) wall thickness, and a 813.6 Mpa (118 KSI) tensile strength. The outer housing had an 21.6 centimeter (8.5 inch) outer diameter, a 18.9 centimeter (7.4 inch) inner diameter, a 1.35 centimeter (0.53 inch) wall thickness, and a 723.95 Mpa (105 KSI) tensile strength.

The second test was conducted at ambient temperature with the following conditions. Pressure: 20.7 Mpa (3,000 psi). Fluid: water. Centralized Shooting Clearance: 0.09 centimeters (0.035 inches). Clearance between the 17.8 centimeter (7 inch) outer diameter of the test pipe and the inner diameter of the housing: 0.55 centimeters (0.22 inches). After the sample "A" explosive unit was detonated, the swell on the 17.8 centimeter (7 inch) test pipe measured at 18.9 centimeters (7.441 inches)×18.89 centimeters (7.44 inches), indicating that the inner diameter of the outer housing (18.88 centimeters (7.433 inches)) somewhat retarded the swell (19.3 centimeters (7.6 inches)) observed in the first test series involving sample "A". There was thus a "bounce back" of the swell that was caused by the inner diameter of the outer housing. In addition, the inner diameter of outer housing increased from 18.88 centimeters (7.433 inches) to 18.98 centimeters (7.474 inches). The clearance between the outer diameter of the test pipe and the inner diameter of the outer housing was reduced from 0.55 centimeters (0.22 inches) to 0.08 centimeters (0.03 inches). FIG. 10A shows a graph illustrating the swell profiles of the test pipe and the outer housing. FIG. 10B is a graph illustrating an overlay of the swell profiles showing the 0.08 centimeter (0.03 inch) resulting clearance.

An additional series of tests was performed to compare the performance a shaped charge tool 10 (having liner-less explosive units 60) and dual end firing explosive column tools 1 having different explosive unit load weights. In the second series of tests, the goal was to maximize the expansion of a 17.8 centimeter (7 inch) outer diameter pipe having a wall thickness of 1.37 centimeters (0.54 inches), to facilitate operations on a Shell North Sea Puffin well. Table 2 shows the results of the tests, with test #1 to #3 being performed with the shaped charge tool 10 (having liner-less explosive units 60), tests #4 and #5 being performed with a modified pressure balanced pellet tool 1, and test #6 being performed with a modified pressure balanced pellet tool having a scab housing. Some of the conditions of the test were as follows. Product information: HE-4-2625-HMX-Expansion (Peek); 1.4D hazard class; 80 grams (2.82 ounces) total NEC including detonating cord and initiation pellet; and 25 38.8-gram (1.4 ounces) HMX pellets (equaling 950 grams (33.5 ounces) of explosive weight). Pipe information: P-110 alloy; 50.8 centimeters (20 inches) in length; 17.8 centimeters (7.0 inch) outer diameter; 5.3 kg/meter (38 lb/ft); 15.04 centimeter (5.920 inch) inner diameter; and a wall thickness ranging from 1.35 centimeters (0.530 inches) to 1.46 centimeters (0.575 inches) throughout the pipe. Test Conditions: centralized shooting clearance of 4.19 centimeters (1.650 inches) on average; 70,050 Kpa (10,160 psi) of pressure; ambient temperature; water used as the fluid; and a charge location at the center of the length of the pipe.

TABLE 2

| Test | Explosive Weight | Explosive Unit Load Weight/1" | Centralized Shooting Clearance | Max Swell of 7" O.D. Pipe |
|---|---|---|---|---|
| 1 | 175 g HMX (6.17 oz.) | 125 g (4.4 oz.) | 0.26 cm (0.103 inches) | 18.8 cm (7.38 inches) |
| 2 | 217 g HMX (7.65 oz.) | 145 g (5.11 oz.) | 0.26 cm (0.103 inches) | 19.02 cm (7.49 inches) |
| 3 | 350 g HMX (12.35 oz.) | 204 g (7.2 oz.) | 0.26 cm (0.103 inches) | 20.2 cm (7.95 inches) |
| 4 | 798 g HMX (28.2 oz.) | 133 g (4.7 oz.) | 4.2 cm (1.650 inches) | 20.63 cm (8.124 inches) |
| 5 | 950 g HMX (33.5 oz.) | 133 g (4.7 oz.) | 4.2 cm (1.650 inches) | 21.16 cm (8.330 inches) |
| 6 | 950 g HMX (33.5 oz.) | 133 g (4.7 oz.) | 4.2 cm (1.650 inches) | 21.42 cm (8.434 inches) |

Tests #1 to #3 used the shaped charge tool 10 having liner-less explosive units 60 with progressively increasing explosive weights. In those tests, the resulting swell of the 17.8 centimeter (7 inch) outer diameter pipe continued to increase as the explosive weight increased. However, in test #3, which utilized 350 gram (12.35 ounces) HMX resulting in a 204 gram (7.2 ounce) unit loading, the focused energy of the expansion charged breached the 17.8 centimeter (7 inch) outer diameter pipe. Thus, to maximize the expansion of this pipe without breaching the pipe would require the amount of explosive energy in test #3 to be delivered with less focus.

Tests #4 and #5 used a modified pressure balanced pellet tool 1, with test #4 having a 16 centimeter (6.3 inch) explosive column and test #5 having a 19.02 centimeter (7.5 inch) explosive column, with a modified, shortened timing spool to ensure that the two explosive shock waves collide in the middle of the column. The modified pressure balanced pellet tool 1 of test #4, with a 798 gram (28.15 ounces) explosive weight, generated a swell of 20.63 centimeters (8.12 inches) without breaching the pipe. The inner diameter of the pipe showed gradual expansion compared with the focused recessed channel resulting from the expansion in tests #1 to #3. Test #5 was conducted to further increase the swell, and so the explosive load was increased from 798 grams (28.15 ounces) to 950 grams (33.5 ounces). In addition, the length of the explosive column increased from 16 centimeters (6.3 inches) (test #4) to 19.02 centimeters (7.5 inches) (Test #5). The modified pressure balanced pellet tool 1 of test #5, with a 950 gram (33.5 ounces) explosive weight, generated a swell of 21.2 centimeters (8.33 inches) without breaching the pipe. Similar to test #4, the inner diameter of the pipe in test #5 also showed gradual expansion compared with the focused recessed channel resulting from the expansion in tests #1 to #3. Test #5, which produced a 21.16 centimeters (8.33 inches) outer diameter swell in the pipe, left a clearance of 0.5 centimeters (0.195 inches) to the 21.65 centimeter (8.525 inches) inner diameter of the 24.46 centimeter (9.63 inch) pipe in the Puffin well. In both tests #4 and #5, the expansion of the pipe was greater on the side where the thickness ranged toward 1.35 centimeters (0.531 inches) and less on the side of the pipe where the thickness ranged toward 1.42 centimeters (0.560 inches).

Test #6 was conducted using a 6.68 centimeter (2.63 inch) outer diameter modified pressure bearing pellet tool 1' having a "scab housing" made of PEEK material, in order to establish the effects of the "scab housing" on the tool and on the pipe to be expanded. The result of test #6 was a 21.42 centimeter (8.434 inch) outer diameter swell in the pipe. The marginally larger swell, as compared with tests #4 and #5, suggest that the "scab housing" had no negative effects. In the test, about two-fifths of the PEEK "scab housing" remained as debris, which may not be a concern as the debris may be easily millable.

The results from tests #4 and #5 show that the swell of the pipe was incrementally increased, without breaching the pipe, using the same explosive material per unit length (i.e., 133 grams (4.69 ounces)). Test #6 showed that the PEEK scab housing had no material effect on the expansion of the pipe when compared to test #5.

The method discussed above may include expanding the wall of the tubular T1 at a second location L2 (see FIG. 9B) spaced from the first location L1 in a direction parallel to an axis of the tool 10 to create a pocket outside the tubular T1 between the first and second locations L1, L2.

Figure 11:
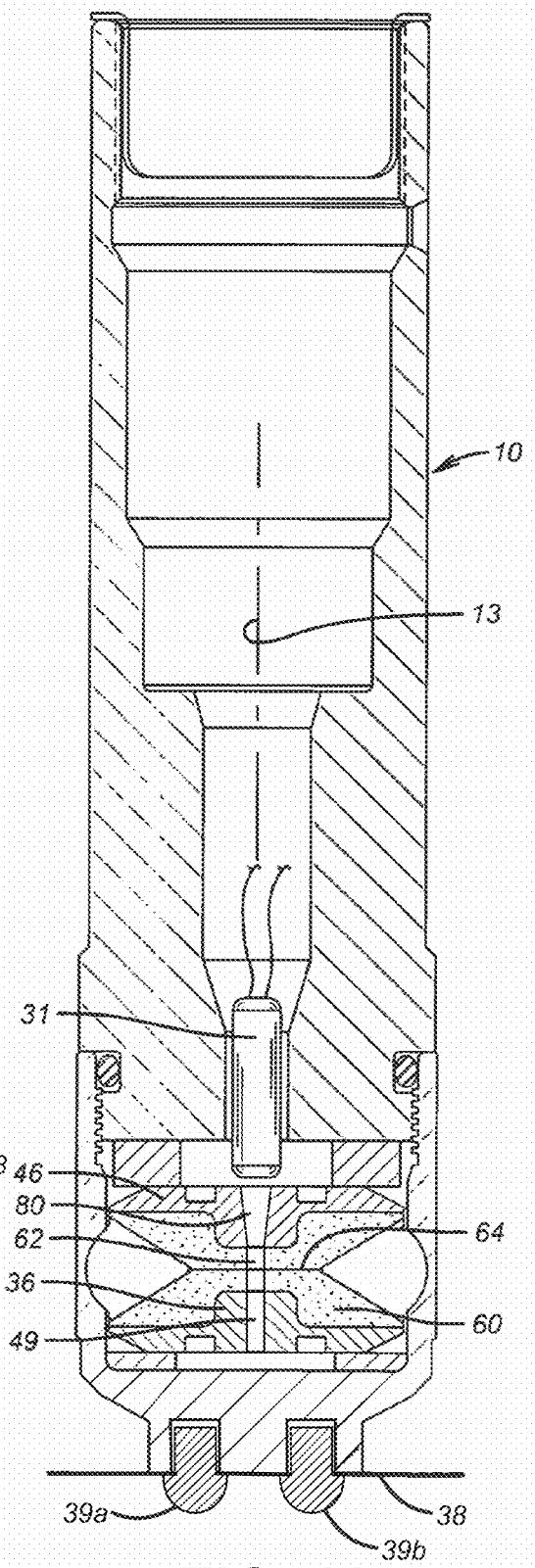
FIG. 11 is a cross-section of an embodiment of the tool, including a shaped charge assembly.

A variation of the toot 10 is illustrated in FIG. 11. As shown in this embodiment, the axial aperture 80 in the backup plate 46 can be tapered with a conically convergent diameter from the disc face proximate of the detonator 31 to the central aperture 62. The backup plate aperture 80 may have a taper angle of about 10 degrees between an approximately 0.203 centimeter (0.080 inch) inner diameter to an approximately 0.318 centimeter (0.125 inch) diameter outer diameter. The taper angle, also characterized as the included angle, is the angle measured between diametrically opposite conical surfaces in a plane that includes the conical axis 13.

Original initiation of the FIG. 11 charge 60 occurs at the outer plane of the tapered aperture 80 having a proximity to a detonator 31 that enables enhances initiation of the charge 60 and the concentration of the resulting explosive force. The initiation shock wave propagates inwardly along the tapered aperture 80 toward the explosive junction plane 64. As the shock wave progresses axially along the aperture 80, the concentration of shock wave energy intensifies due to the progressively increased confinement and concentration of the explosive energy. Consequently, the detonator shock wave can strike the charge units 60 at the inner juncture plane 64 with an amplified impact. Comparatively, the same explosive charge units 60, as suggested for FIG. 8, comprising, for example, approximately 38.8 gms (1.4 ounces) of HMX compressed under a loading pressure of about 20.7 Mpa (3,000 psi), when placed in the FIG. 11 embodiment, may require only a relatively small detonator 31 of HMX for detonation. Significantly, the conically tapered aperture 80 of FIG. 11 appears to focus the detonator energy to the central aperture 62, thereby igniting a given charge with much less source energy. In FIGS. 8 and 11, the detonator 31 emits a detonation wave of energy that is reflected (bounce-back of the shock wave) off the flat internal end-face 33 of the integral end wall 32 of the housing 20 thereby amplifying a focused concentration of detonation energy in the central aperture 62. Because the tapered aperture 80 in the FIG. 11 embodiment reduces the volume available for the detonation wave, the concentration of detonation energy becomes amplified relative to the FIG. 8 embodiment that does not include the tapered aperture 80.

Figure 12:
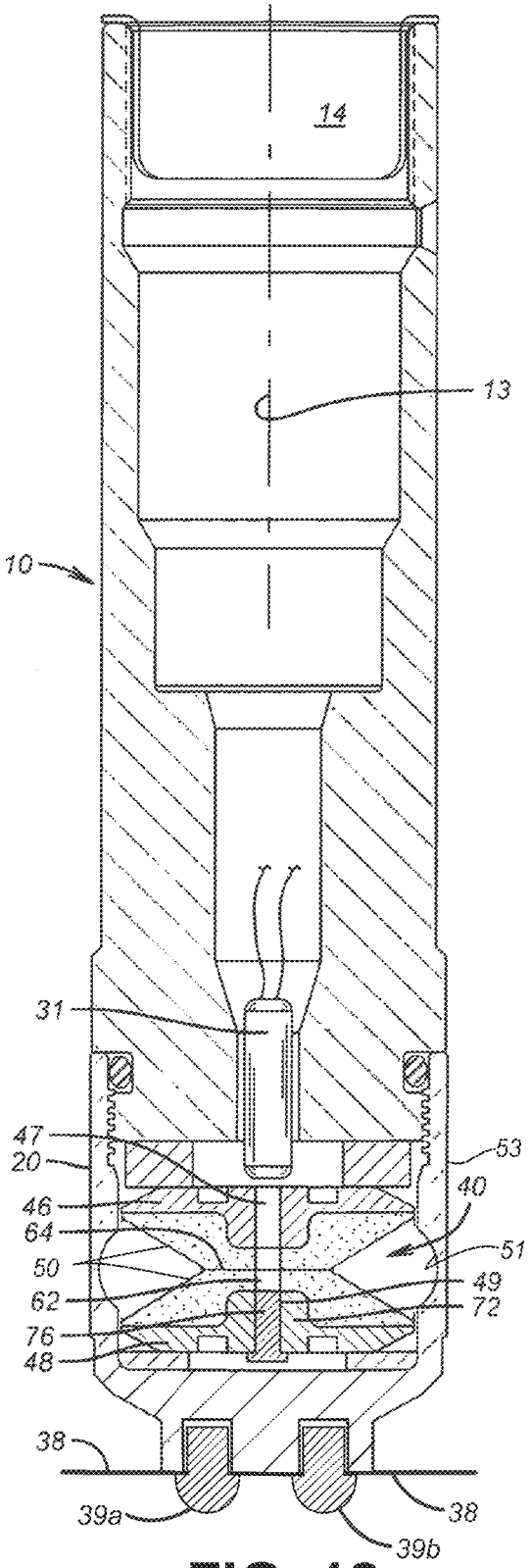
FIG. 12 is a cross-section of another embodiment of the tool, including a shaped charge assembly.

The variation of the tool 10 shown in FIG. 12 relies upon an open, substantially cylindrical aperture 47 in the upper backup plate 46, as shown in the FIG. 8 embodiment. However, either no aperture is provided in the end plate boss 72 of FIG. 12 or the aperture 49 in the lower end plate 48 is filled with a dense, metallic plug 76. The plug 76 may be inserted in the aperture 49 upon final assembly or pressed into place beforehand. As in the case of the FIG. 11 embodiment, the FIG. 12 tool 10 comprising, for example, approximately 38.8 gms (1.4 ounces) of HMX compressed under a loading pressure of about 20.7 Mpa (3,000 psi), also may require only a relatively small detonator 31 of HMX for detonation. The detonation wave emitted by the detonator 31 is reflected hack upon itself in the central aperture 62 by the plug 76, thereby amplifying a focused concentration of detonation energy in the central aperture 62.

Figure 13:
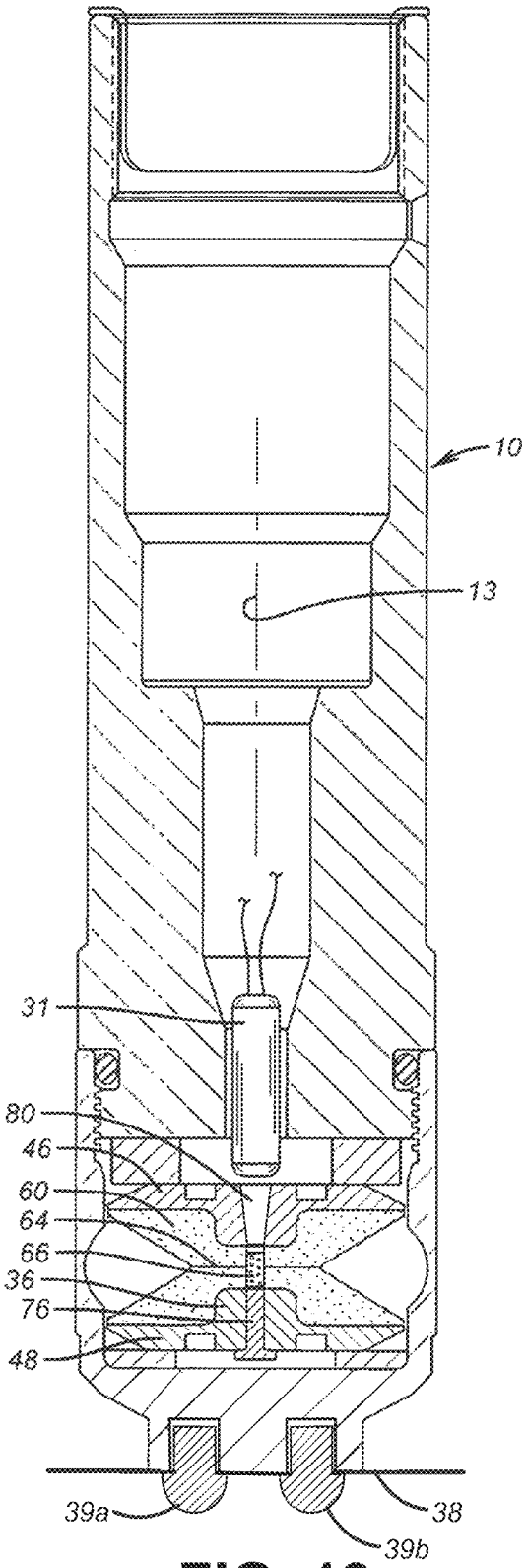
FIG. 13 is a cross-section of another embodiment of the tool, including a shaped charge assembly.

The FIG. 13 variation of the tool 10 combines the energy concentrating features of FIG. 11 and FIG. 12, and adds a relatively small, explosive initiation pellet 66 in the central aperture 62. In this case, the detonation wave of energy emitted from the detonator 31 is reflected off of explosive initiation pellet 66. The reflection from the off of explosive initiation pellet 66 is closer to the juncture plane 64, which results in a greater concentration of energy (enhanced explosive force). The explosive initiation pellet 66 concept can be applied to the FIG. 8 embodiment, also.

As discussed above, one of the ways to mitigate the hazard associated with transporting and storing the explosive units is to divide the units into smaller explosive components. Each of the explosive units 60 discussed herein may thus be provided as a set of units that can be transported unassembled, where their physical proximity to each other in the shipping box would prevent mass (sympathetic) detonation if one explosive component was detonated, or if, in a fire, would burn and not detonate. The set is configured to be easily assembled at the job site without the use of tools.

Figure 17:
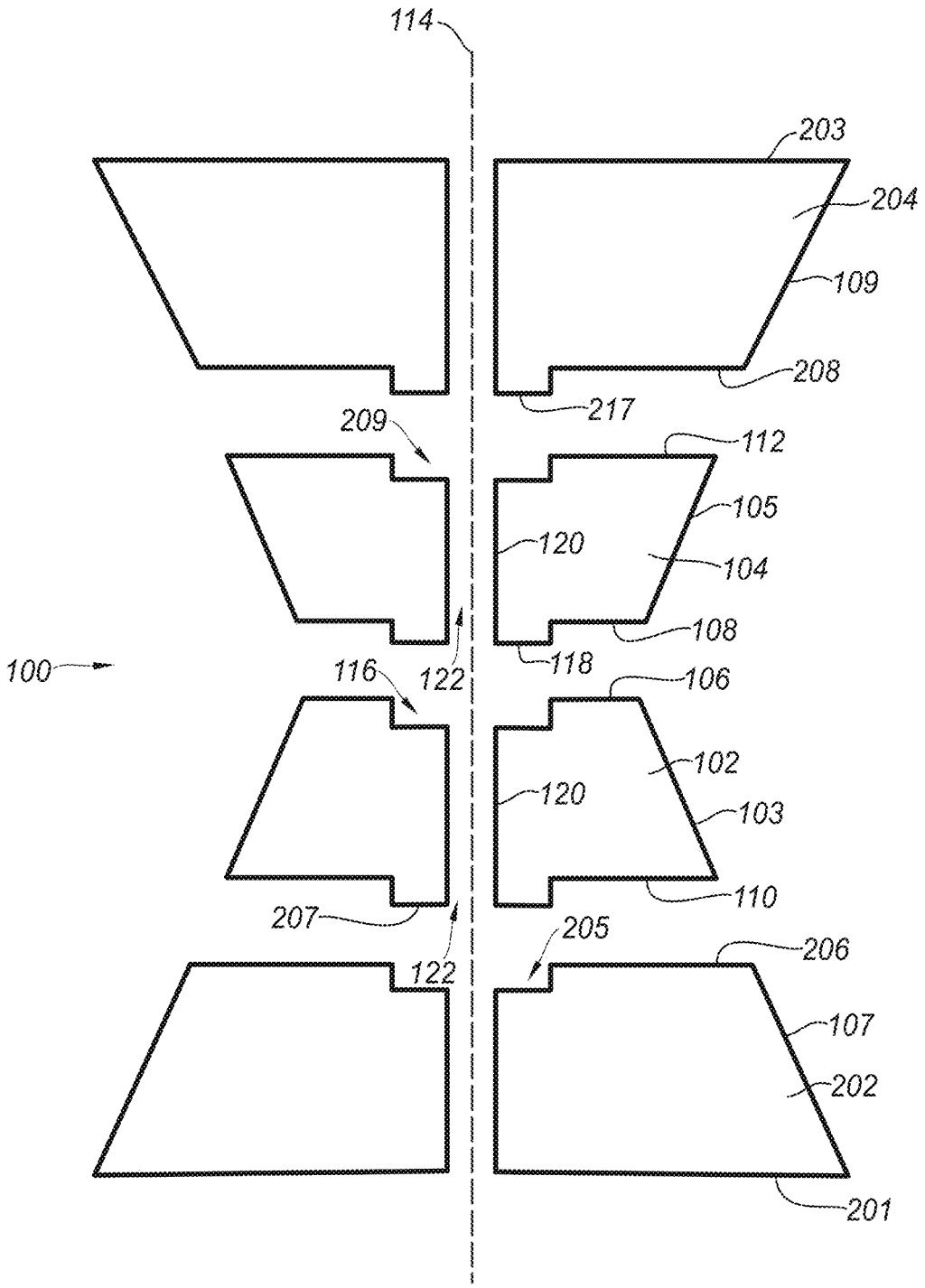
FIG. 17 illustrates an embodiment of a set of explosive units.

FIG. 17 shows an exemplary embodiment of a set 100 of explosive units. Embodiments of the explosive units discussed herein may be configured as the set 100 discussed below. The set 100 comprises a first explosive unit 102 and a second explosive unit 104. Each of the first explosive unit 102 and the second explosive unit 104 comprises the explosive material discussed herein. Each explosive unit 102, 104 may be frusto-conically shaped. In this configuration, the first explosive unit 102 can include a smaller area first surface 106 and a greater area second surface 110 opposite to the smaller area first surface 106. Similarly, the second explosive unit 104 can include a smaller area first surface 108 and a greater area second surface 112 opposite to the smaller area first surface 108. Each of the first explosive unit 102 and the second explosive unit 104 can be symmetric about a longitudinal axis 114 extending through the units, as shown in the perspective view of FIG. 18. Each of the first explosive unit 102 and the second explosive unit 104 can comprise a center portion 120 having an aperture 122 that extends through the center portion 120 along the longitudinal axis 114.

In the illustrated embodiment, the smaller area first surface 106 of the first explosive unit 102 can include a recess 116, and the smaller area first surface 108 of the second explosive unit 104 can comprise a protrusion 118. As shown, the first explosive unit 102 and the second explosive unit 104 are configured to be connected together with the smaller area first surface 106 of the first explosive unit 102 facing the second explosive unit 104, and the smaller area first surface 108 of the second explosive unit 104 facing the smaller area first surface 106 of the first explosive unit 102. As shown, the protrusion 118 of the second explosive unit 104 can fit into the recess 116 of the first explosive unit 102 to join the first explosive unit 102 and the second explosive unit 104 together. The first explosive unit 102 and the second explosive unit 104 can thus be easily connected together without using tools or other materials.

Figure 20:
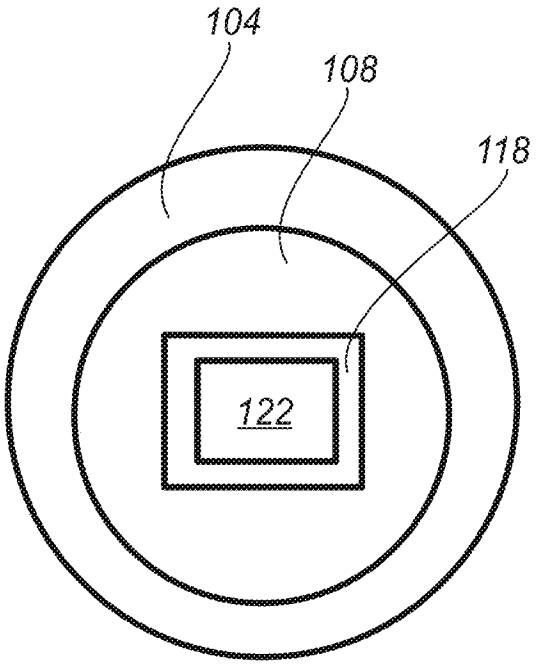
FIG. 20 shows a planform view of an alternative explosive unit in the set.
Figure 19:
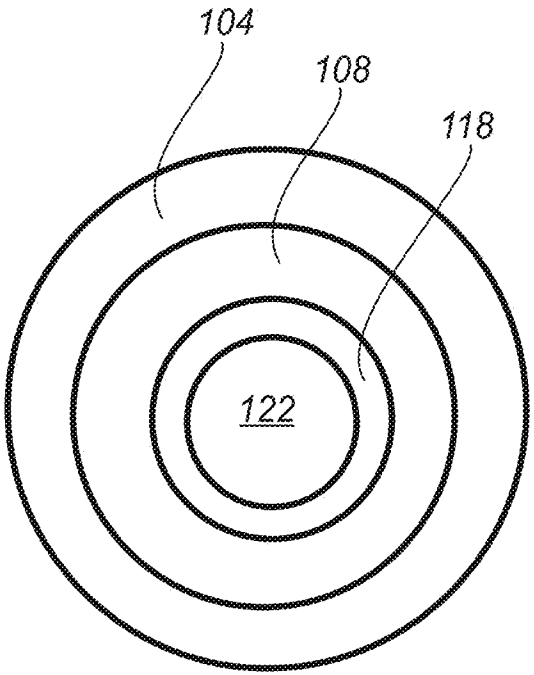
FIG. 19 shows a planform view of an explosive unit in the set.
Figure 18:
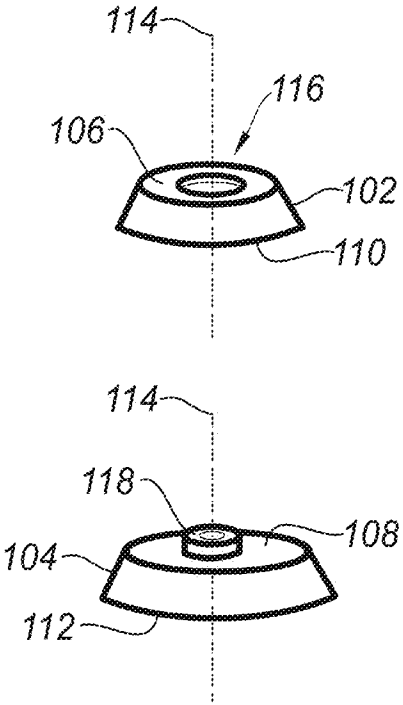
FIG. 18 illustrates a perspective view of explosive units in the set.

In the embodiment, the protrusion 118 and the recess 116 have a circular shape in planform, as shown in FIGS. 18 and 19. In other embodiments, the protrusion 118 and the recess 116 may have a different shape. For instance, FIG. 20 shows that the shape of the protrusion 118 is square. The corresponding recess (not shown) on the other explosive unit in this embodiment is also square to fitably accommodate the protrusion 118. Alternative shapes for the protrusion 118 and the recess 116 may be triangular, rectangular, pentagonal, hexagonal, octagonal or other polygonal shape having more than two sides.

The set 100 of explosive units may further include a first explosive sub unit 202 and a second explosive sub unit 204. The first explosive sub unit 202 can be configured to be connected to the first explosive unit 102, and the second explosive sub unit 204 can be configured to be connected to the second explosive unit 104, as discussed below. Similar to the first and second explosive units 102, 104 discussed above, each of the first explosive sub unit 202 and the second explosive sub unit 204 can be frusto-conical so that the sub units define a smaller area first surface 206, 208 and a greater area second surface 201, 203 opposite to the smaller area first surface 206, 208, as shown in FIG. 17.

In the embodiment shown in FIG. 17, the larger area second surface 110 of the first explosive unit 102 can include a first projection 207, and the smaller area first surface 206 of the first explosive sub unit 202 can include a first cavity 205. The first projection 207 can fit into the first cavity 205 to join the first explosive unit 102 and the first explosive sub unit 202 together. Of course, instead of having the first projection 207 on the first explosive unit 102 and the first cavity 205 on the first explosive sub unit 202, the first projection 207 may be provided on the smaller area first surface 206 of the first explosive sub unit 202 and the first cavity 205 may be provided on the larger area second surface 110 of the first explosive unit 102.

FIG. 17 also shows that the larger area second surface 112 of the second explosive unit 104 comprises a first cavity 209, and the smaller area first surface 208 of the second explosive sub unit 204 comprises a first projection 217. The first projection 217 can fit into the first cavity 209 to join the second explosive unit 102 and the second explosive sub unit 204 together. Of course, instead of having the first projection 217 on the second explosive sub unit 204 and the first cavity 209 on the second explosive unit 104, the first projection 217 may be provided on the larger area second surface 112 of the second explosive unit 104 and the first cavity 209 may be provided on the smaller area first surface 208 of the second explosive sub unit 204. The first and second explosive sub units 202, 204 may also include an aperture 122 extending along the longitudinal axis 114.

FIGS. 17 and 18 show that the first explosive unit 102 can include a side surface 103 connecting the smaller area first surface 106 and the greater area second surface 110. Similarly, the second explosive unit 104 can include a side surface 105 connecting the smaller area first surface 108 and the greater area second surface 112. Each side surface 103, 105 can consists of only the explosive material, so that the explosive material can be exposed at the side surfaces 103, 105. In other words, a liner that is conventionally applied to the explosive units is absent from the first and second explosive units 102, 104. The side surfaces 107, 109 of the first and second explosive sub units 202, 204 can consist of only the explosive material, so that the explosive material can be exposed at the side surfaces 107, 109, and the liner is absent from the first and second explosive sub units 202, 204.

Figure 21:
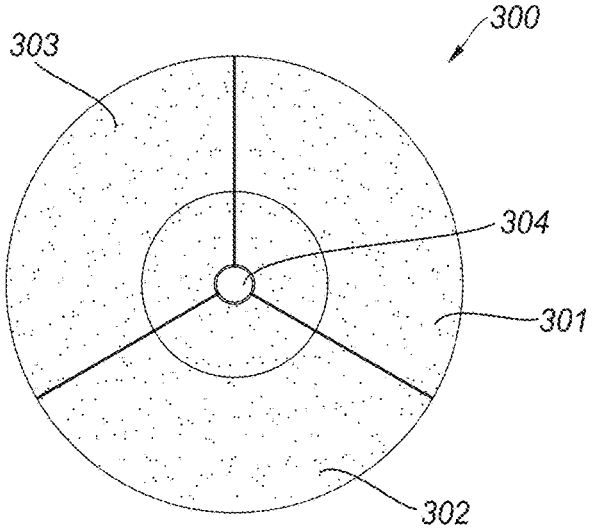
FIGS. 21-24 illustrate another embodiment of an explosive unit that may be included in a set of several similar units.
Figure 22:
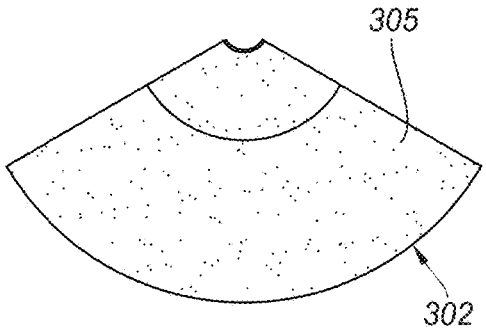
Figure 23:
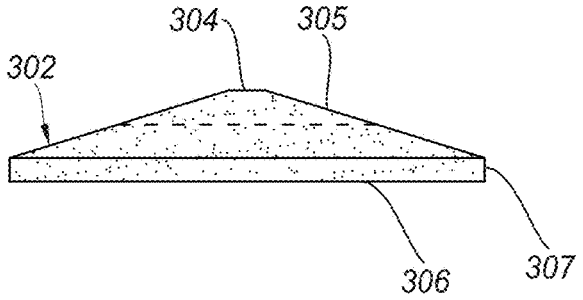
Figure 24:
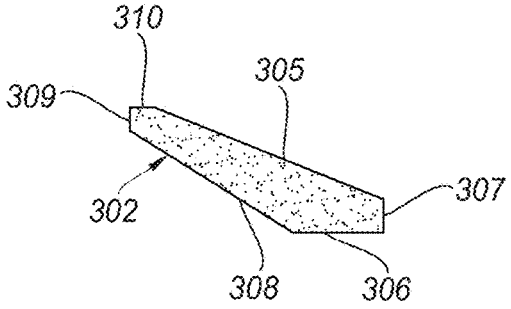

FIGS. 21-24 illustrate another embodiment of an explosive unit 300 that may be included in a set of several similar units 300. The explosive unit 300 may be positioned in a tool 10 at a location and orientation that is opposite a similar explosive unit 300, in the same manner as the explosive material units 60 in FIGS. 1 and 4-6 discussed herein. FIG. 21 is a plan view of the explosive unit 300. FIG. 22 is a plan view of one segment 302 of the explosive unit 300, and FIG. 23 is a side view thereof. FIG. 24 is a cross-sectional side view of FIG. 22. In the embodiment, the explosive unit 300 is in the shape of a frustoconical disc that is formed of three equally-sized segments 301, 302, and 303. The explosive unit 300 may include a central opening 304, as shown in FIG. 21, for accommodating the shaft of an explosive booster (not shown) or detonation cord to initiate the charge (not shown). The illustrated embodiment shows that the explosive unit 300 is formed of three segments 301, 302, and 303, each accounting for one third (i.e., 120 degrees) of the entire explosive unit 300 (i.e., 360 degrees). However, the explosive unit 300 is not limited to this embodiment, and may include two segments or four or more segments depending nature of the explosive material forming segments. For instance, a more highly explosive material may require a greater number of (smaller) segments in order to comply with industry regulations (e.g., United Nations regulations) for safely transporting explosive material. For instance, the explosive unit 300 may be formed of four segments, each accounting for one quarter (i.e., 90 degrees) of the entire explosive unit 300 (i.e., 360 degrees); or may be formed of six segments, each accounting for one sixth (i.e., 60 degrees) of the entire explosive unit 300 (i.e., 360 degrees). According to one embodiment, each segment should include no more than 38.8 grams (1.4 ounces) of explosive material.

In one embodiment, the explosive unit 300 may have a diameter of about 8.4 centimeters (3.3 inches). FIGS. 22 and 23 show that the segment 302 has a top surface 305 and a bottom portion 306 having a side wall 307. The top surface 305 may be slanted an angle of at or around 17 degrees from the central opening 304 to the side wall 307 in an embodiment. According to one embodiment, the overall height of the segment 302 may be about 1.91 centimeters (0.75 inches), with the side wall 307 being about 0.508 centimeters (0.2 inches) of the overall height. The overall length of the segment 302 may be about 7.24 centimeters (2.85 inches) in the embodiment. FIG. 24 shows that the inner bottom surface 308 of the segment 302 may be inclined at an angle of 32 degrees, according to one embodiment. The width of the bottom portion 306 may be about 1.37 centimeters (0.539 inches) according to an embodiment with respect to FIG. 24. The side wall 309 of the central opening 304 may have a height of about 0.356 centimeters (0.14 inches) in an embodiment, and the uppermost part 310 of the segment 302 may have a width of the about 0.381 centimeters (0.15 inches). The above dimensions are not limiting, as the segment size and number may be different in other embodiments. A different segment size and/or number may have different dimensions. The explosive units 300 may be provided as a set of units divided into segments, so that the explosive units 300 can be transported as unassembled segments 301, 302, 303, as discussed above, and used with shaped charge expansion tools for tubular wall expansion. The set of segments is configured to be easily assembled at the job site without the use of tools.

FIGS. 25-29 show embodiments of a centralizer assembly that may be attached to the housing 20. The centralizer assembly centrally confines the tool 10 within the tubular T1. In the embodiment shown in FIG. 25, which shows a planform view of the centralizer assembly, the tool 10 is centralized by a pair of substantially circular centralizing discs 316. Each of the centralizing discs 316 can be secured to the housing 320 by separate anchor pin fasteners 318, such as screws or rivets. In the FIG. 25 embodiment, the discs 316 are mounted along a diameter line 320 across the housing 20, with the most distant points on the disc perimeters separated by a dimension that is preferably at least corresponding to the inside diameter of the tubular T1. In many cases, however, it will be desirable to have a disc perimeter separation slightly greater than the internal diameter of the tubular T1.

Figure 25:
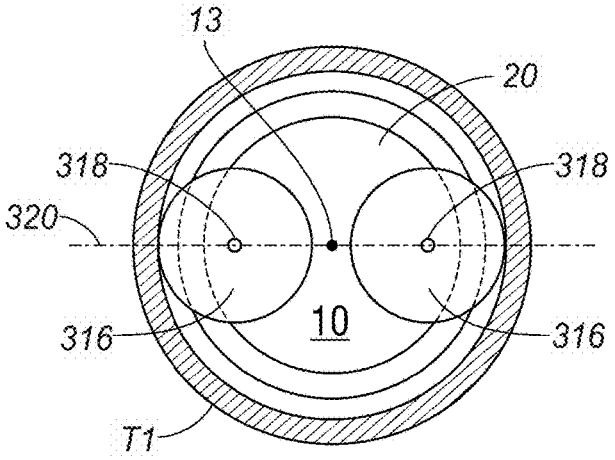
FIG. 25 illustrates an embodiment of a centralizer assembly.
Figure 26:
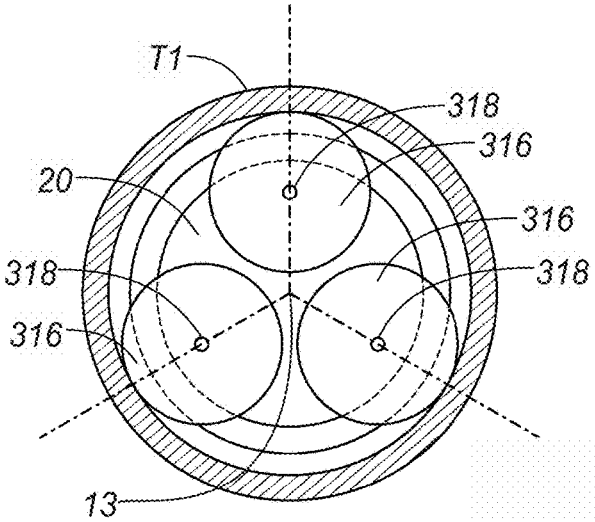
FIG. 26 illustrates an alternative embodiment of a centralizer assembly.
Figure 27:
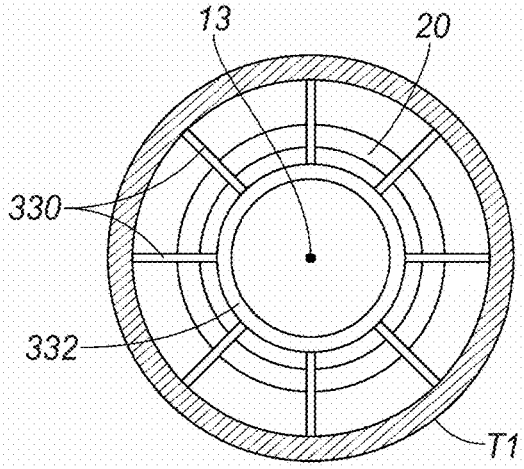
FIG. 27 illustrates another embodiment of a centralizer assembly.

In another embodiment shown by FIG. 26, each of the three discs 316 are secured by separate pin fasteners 318 to the housing 20, at approximately 120 degree arcuate spacing about the longitudinal axis 13 (also shown in FIGS. 25 and 27). This configuration is representative of applications for a multiplicity of centering discs on the housing 20. Depending on the relative sizes of the tool 10 and the tubular T1, there may be three or more such discs distributed at substantially uniform arcs about the tool circumference.

FIG. 27 shows, in planform, a further embodiment which includes spring steel centralizing wires 330 of small gage diameter. A plurality of these wires is arranged radially from an end boss 332. The wires 330 can be formed of high-carbon steel, stainless steel, or any metallic or metallic composite material with sufficient flexibility and tensile strength. While the embodiment includes a total of eight centralizing wires 330, it should be appreciated that the plurality may be made up of any number of centralizing wires 330, or in some cases, as few as two. The use of centralizing wires 330, rather than blades or other machined pieces, allows for the advantageous maximization of space in the flowbore around the centralizing system, compared to previous spider-type centralizers, by minimizing the cross-section compared to systems featuring flat blades or other planar configurations. The wires 330 can be oriented perpendicular to the longitudinal axis 13 and engaged with the sides of the tubular T1. The wires 330 may be sized with a length to exert a compressive fore to the tool 10, and flex in the same fashion as the cross-section of discs 316 during insertion and withdrawal.

Figure 28:
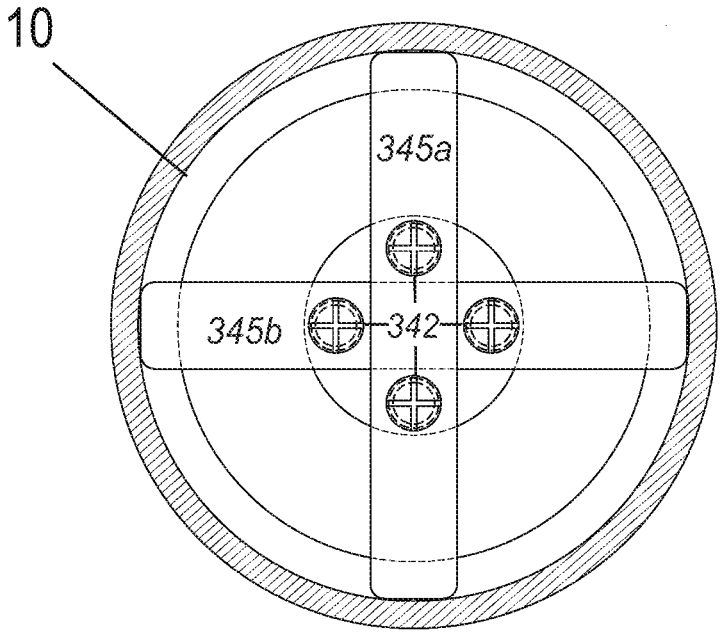
FIGS. 28 and 29 illustrate a further embodiment of a centralizer assembly.
Figure 29:
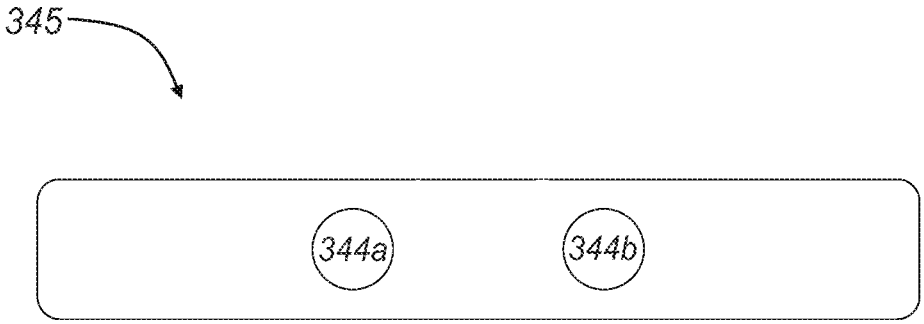

Yet a further embodiment of the centralizer assembly is shown in FIG. 28. This configuration comprises a plurality of planar blades 345*a*, 345*b* to centralize the tool 10. The blades 345*a*. 345*b* are positioned on the bottom surface of the tool 10 via a plurality of fasteners 342. The blades 345*a*, 345*b* thus flex against the sides of the tubular T1 to exert a centralizing force in substantially the same fashion as the disc embodiments discussed above. FIG. 29 illustrates an embodiment of a single blade 345. The blade 345 comprises a plurality of attachment points 344*a*, 344*b*, through which fasteners 342 secure the blade 45 in position. Each fastener 342 can extend through a respective attachment point to secure the blade 345 into position. While the embodiment in FIG. 28 is depicted with two blades 345*a*, 345*b*, and each blade 345 comprises two attachment points, for a total of four fasteners 342 and four attachment points (344*a*, 344*b* are pictured in FIG. 29), it should be appreciated that the centralizer assembly may comprise any number of fasteners and attachment points.

The multiple attachment points 344*a*. 344*b* on each blade 345, being spaced laterally from each other, prevent the unintentional rotation of individual blades 345, even in the event that the fasteners 342 are slightly loose from the attachment points 344*a*, 344*b*. The fasteners 342 can be of any type of fastener usable for securing the blades into position, including screws. The blades 345 can be spaced laterally and oriented perpendicular to each other, for centralizing the tool 10 and preventing unintentional rotation of the one or more blades 345.

Although several preferred embodiments have been illustrated in the accompanying drawings and describe in the foregoing specification, it will be understood by those of skill in the art that additional embodiments, modifications and alterations may be constructed from the principles disclosed herein. These various embodiments have been described herein with respect to selectively expanding the wall of a "pipe" or a "tubular." Clearly, other embodiments of the tool of the present invention may be employed for selectively expanding the wall of any tubular good including, but not limited to, pipe, tubing, production/casing liner and/or casing. Accordingly, use of the term "tubular" in the following claims is defined to include and encompass all forms of pipe, tube, tubing, casing, liner, and similar mechanical elements.

What is claimed is:

1. A method of selectively expanding at least a portion of a wall of a tubular via an expansion tool, comprising:

assembling the expansion tool comprising a plurality of bi-directional boosters;

arranging a predetermined number of explosive pellets in a serially-arranged column between the plurality of bi-directional boosters;

positioning said expansion tool within the tubular;

detonating the plurality of bi-directional boosters to simultaneously ignite opposing ends of the serially-arranged column to form two shock waves that collide to create an amplified shock wave that travels radially outward to impact the tubular at a first location and expand said at least a portion of the wall of the tubular radially outward without perforating or cutting through said at least a portion of the wall, to form a protrusion of the tubular at said at least a portion of the wall, wherein the protrusion extends into an annulus adjacent an outer surface of the wall of the tubular; and setting a plug in the tubular below the protrusion.

2. The method according to claim 1, wherein formation of the protrusion causes the at least a portion of the wall that forms the protrusion to be work-hardened so that the at least a portion of the wall forming the protrusion has a greater yield strength than other portions of the wall that are adjacent the protrusion.

3. The Method according to claim 1, further comprising providing a sealant onto said protrusion.

4. The method according to claim 3, wherein the sealant is cement.

5. The method according to claim 3, further comprising:

expanding the tubular at a second location spaced from the first location in a direction parallel to an axis of the expansion tool to create a pocket outside the tubular between the first location and second the location, wherein the sealant is in the pocket.

6. The method according to claim 1, further comprising:

shooting perforating puncher charges through the wall of the tubular above the protrusion to form communication ports from an inner diameter of the tubular to the annulus.

7. The method according to claim 6, further comprising:

pumping a sealant into the tubular, and into the annulus via the communication ports.

8. A method of selectively expanding at least a portion of a wall of a tubular via an expansion tool, comprising:

determining a hydrostatic pressure bearing on the tubular;

assembling the expansion tool comprising a plurality of bi-directional boosters;

selecting a predetermined number of explosive pellets based at least in part on the hydrostatic pressure;

arranging the predetermined number of explosive pellets in a serially-arranged column between the plurality of bi-directional boosters;

positioning said expansion tool within the tubular;

detonating the bi-directional boosters to simultaneously ignite opposing ends of the serially-arranged column to form two shock waves that collide to create an amplified shock wave that travels radially outward to impact the tubular at a first location and expand said at least a portion of the wall of the tubular radially outward without perforating or cutting through said at least a portion of the wall, to form a protrusion of the tubular at said at least a portion of the wall, wherein the protrusion extends into an annulus adjacent an outer surface of the wall of the tubular; and setting a plug in the tubular below the protrusion.

9. The method according to claim 8, wherein the predetermined number of explosive pellets is further based on at least one of:

a material of the tubular;

a thickness of the wall of the tubular;

an inner diameter of the tubular;

an outer diameter of the tubular; and a size of the protrusion to be formed in the wall of the tubular.

10. The method according to claim 8, wherein the explosive pellets are serially aligned along, an axis of the expansion tool.

11. The method according to claim 8, wherein the annulus is between an outer surface of the wall of the tubular and an inner surface of a wall of another tubular.

12. The method according to claim 8, wherein the annulus is between an outer surface of the wall of the tubular and a formation of a wellbore containing the tubular.

13. The method according to claim 8, wherein the expansion tool comprises a guide tube, and the guide tube comprises the plurality of bi-directional boosters and the predetermined number of explosive pellets.

14. The method according to claim 8, further comprising:

shooting perforating puncher charges through the wall of the tubular above the protrusion to form communication ports from an inner diameter of the tubular to the annulus.

15. The method according to claim 14, further comprising:

pumping a sealant into the tubular, and into the annulus via the communication ports.

* * * * *